US008544305B2

(12) United States Patent
Watabe et al.

(10) Patent No.: US 8,544,305 B2
(45) Date of Patent: Oct. 1, 2013

(54) CONVEYING JIG, METHOD OF MANUFACTURING CONVEYING JIG, AND METHOD OF HEAT-TREATING METAL RINGS USING CONVEYING JIG

(75) Inventors: Yoshiharu Watabe, Iruma (JP); Seiichi Minegishi, Sakado (JP); Tetsuo Suzuki, Tochigi-ken (JP); Masaomi Saruyama, Utsunomiya (JP); Masashi Takagaki, Sakura (JP)

(73) Assignee: Honda Motor Co., Ltd., Tokyo (JP)

( * ) Notice: Subject to any disclaimer, the term of this patent is extended or adjusted under 35 U.S.C. 154(b) by 181 days.

(21) Appl. No.: 13/140,379

(22) PCT Filed: Oct. 22, 2009

(86) PCT No.: PCT/JP2009/068159

§ 371 (c)(1),
(2), (4) Date: Jun. 16, 2011

(87) PCT Pub. No.: WO2010/070980

PCT Pub. Date: Jun. 24, 2010

(65) Prior Publication Data

US 2011/0252852 A1 Oct. 20, 2011

(30) Foreign Application Priority Data

Dec. 17, 2008 (JP) ..... 2008-321253
Mar. 13, 2009 (JP) ..... 2009-061354
Mar. 26, 2009 (JP) ..... 2009-076126

(51) Int. Cl.
*C21D 9/40* (2006.01)
*C21D 1/00* (2006.01)
*B21D 26/02* (2011.01)

(52) U.S. Cl.
USPC ..... 72/56; 72/58; 72/61; 72/226; 269/287; 432/253

(58) Field of Classification Search
USPC ..... 72/54, 56, 58, 61, 62, 226, 252.5, 72/364; 269/287; 432/253
See application file for complete search history.

(56) References Cited

U.S. PATENT DOCUMENTS 6,607,381 B2 * 8/2003 Minami et al. ..... 432/258
6,796,439 B2 * 9/2004 Araki ..... 211/41.18

(Continued)

FOREIGN PATENT DOCUMENTS

EP 1 801 245 A1 6/2007
JP 09-298164 A 11/1997

(Continued)

OTHER PUBLICATIONS

Chinese First Office Action, Application No. 200980150701.0 issued on Dec. 4, 2012.

(Continued)

*Primary Examiner* — David B Jones
(74) *Attorney, Agent, or Firm* — Arent Fox LLP

(57) ABSTRACT

Provided are a conveying jig, a method of manufacturing the conveying jig, and a method of heat-treating metal rings using the conveying jig. The conveying jig is provided with a base and ten holding shafts raised from the base. Ridges and grooves are alternatively provided in the side wall of each holding shaft. The metal rings are held in position by being engaged in the grooves in the holding shafts. The space enclosed within the holding shafts is communicated with the atmosphere, and this allows, when the metal rings held by the conveying jig are subjected to heat treatment in a heat treatment furnace, an atmospheric gas to circulate in the space enclosed within the holding shafts.

24 Claims, 25 Drawing Sheets

(56) References Cited

U.S. PATENT DOCUMENTS

| | | | | |
|---|---|---|---|---|
| 7,484,958 | B2 * | 2/2009 | Kobayashi | 432/258 |
| 2002/0092815 | A1 * | 7/2002 | Kim et al. | 211/41.18 |
| 2005/0282101 | A1 * | 12/2005 | Adachi | 432/253 |
| 2011/0252852 | A1 * | 10/2011 | Watabe et al. | 72/54 |

FOREIGN PATENT DOCUMENTS

| | | | |
|---|---|---|---|
| JP | 11-176763 | A | 7/1999 |
| JP | 2000-357661 | A | 12/2000 |
| JP | 2002-161314 | A | 6/2002 |
| JP | 2006-291339 | A | 10/2006 |
| JP | 2007-191788 | A | 8/2007 |
| JP | 3986995 | B2 | 10/2007 |
| JP | 2008-240085 | A | 10/2008 |
| JP | 4219186 | B2 | 2/2009 |
| WO | 2007/008383 | A2 | 1/2007 |

OTHER PUBLICATIONS

Japanese Office Action, Application No. 2009-061354 issued Jun. 18, 2013.

Japanese Office Action, Application No. 2008-321253 issued Aug. 6, 2013.

* cited by examiner

CONVEYING JIG, METHOD OF MANUFACTURING CONVEYING JIG, AND METHOD OF HEAT-TREATING METAL RINGS USING CONVEYING JIG

CROSS-REFERENCE TO RELATED APPLICATION

This application is a National Stage entry of International Application No. PCT/JP2009/068159, filed Oct. 22, 2009, which claims priority to Japanese Patent Application No. 2008-321253, filed Dec. 17, 2008, Japanese Patent Application No. 2009-061354, filed Mar. 13, 2009, and Japanese Patent Application No. 2009-076126, filed Mar. 26, 2009, the entire specification claims and drawings of which are incorporated herewith by reference.

TECHNICAL FIELD

The present invention relates to a feed jig (conveying jig) for feeding metal rings for use as continuously variable transmission (CVT) belts. The present invention further relates to a method of manufacturing a feed jig, and a method of heat-treating metal rings using a feed jig.

BACKGROUND ART

CVTs have a belt made up of a plurality of stacked metal rings for transmitting power. The stacked metal rings include a plurality of metal rings having slightly different circumferential lengths, which are successively stacked on outer circumferential sides of inner adjacent metal rings.

Generally, each of the metal rings, which have different circumferential lengths, is fabricated by cutting a cylindrical drum of maraging steel into a preform having a prescribed width, heat-treating the preform according to a solution heat treatment, an aging treatment, a nitriding treatment, etc., and correcting the circumferential length of the preform by elongating the preform in order to increase the circumferential length to a prescribed dimension (see, for example, Japanese Patent No. 3986995).

In some cases, a flat plate having a prescribed thickness is used instead of the cylindrical drum. Such a flat plate is curved until end faces thereof abut against each other, so that the flat plate is changed into a cylindrical shape. Then, the end faces, which are held in abutment against each other, are joined together. Thereafter, various heat treatments referred to above are performed.

For performing such heat treatments, it is the general practice to feed a plurality of metal rings held by a feed jig into a heat treatment furnace in which the metal rings and the feed jig are heated together. For example, the present applicant has proposed feed jigs of this type, as disclosed in Japanese Laid-Open Patent Publication No. 2002-161314 and Japanese Patent No. 4219186.

There are also known feed jigs, as disclosed in Japanese Laid-Open Patent Publication No. 2007-191788 and Japanese Laid-Open Patent Publication No. 2008-240085.

As shown in FIG. 3 of Japanese Laid-Open Patent Publication No. 2007-191788, the feed jig disclosed therein includes a base plate and six solid holder shafts vertically mounted on the base plate. Each of the solid holder shafts has a plurality of ring seats, which project horizontally from a side wall thereof. As shown in FIG. 4 of this publication, a metal ring is held by the feed jig, while the side wall of the metal ring is engaged between ring seats of the six solid holder shafts.

The feed jig disclosed in Japanese Laid-Open Patent Publication No. 2008-240085 also holds a metal ring between ring seats that project from side walls of six holder shafts, which extend parallel to each other (see FIGS. 6 through 8 of Japanese Laid-Open Patent Publication No. 2008-240085).

As described above, both of the feed jigs disclosed in Japanese Laid-Open Patent Publication No. 2007-191788 and Japanese Laid-Open Patent Publication No. 2008-240085 have ring seats that project from side walls of the holder shafts in the form of round rods in directions perpendicular to the direction in which the holder shafts extend. Tapered slanted surfaces are interposed between vertices of the ring seats and the side walls of the holder shafts. A metal ring is inserted between slanted surfaces of lower ring seats and slanted surfaces of upper ring seats (see FIG. 4 of Japanese Laid-Open Patent Publication No. 2007-191788).

SUMMARY OF INVENTION

The feed jig disclosed in Japanese Laid-Open Patent Publication No. 2007-191788 is heavy, and hence needs to be fed into the heat treatment furnace under large feeding forces. In other words, when the disclosed feed jig is used, a large amount of electric power must be consumed, and thus the feed jig is disadvantageous in terms of cost.

Furthermore, when a nitriding treatment is performed on the metal rings, which are held by the disclosed feed jig, junctions between the ring seats and the metal rings may not be nitrided sufficiently. As well known in the art, a nitriding treatment is a treatment for increasing surface hardness of metals. If a metal ring is irregularly nitrided, then the surface hardness of the metal ring becomes irregular. When the surface hardness of the metal ring is irregular, since properties thereof including mechanical strength are different from region to region, it is not easy to produce a metal ring that is homogenous in its entirety.

The reason for such a failure is that the temperature of the feed jig rises at a rate that is lower than that of the metal ring. Stated otherwise, when heated, the feed jig exhibits a lower thermal followability than the metal rings. Therefore, the diameter changing ratio of the metal ring at a time when the metal ring is heat-treated (i.e., the ratio as a percentage of reduction in the diameter of the metal ring when the metal ring is heat-treated to the diameter of the metal ring when the metal ring is circular in shape) tends to increase.

If such a phenomenon occurs, then deformation of the metal ring needs to be corrected in addition to the aforementioned correction of circumferential length. However, since such a correcting process is time-consuming, the production efficiency of such metal rings is lowered.

Furthermore, for fabricating a solid holder shaft, as disclosed in Japanese Laid-Open Patent Publication No. 2007-191788, it is necessary to form the ring seats by cutting side walls of the solid rods. As a result, chips are produced, and processing costs are incurred in order to discard such produced chips. Further, since part of the raw material is thrown away, usage efficiency of the raw material is low. In addition, solid rods are generally expensive and are disadvantageous in terms of cost.

As can be understood from FIG. 4 of Japanese Laid-Open Patent Publication No. 2007-191788, sharp edges are formed between slanted surfaces of the ring seats and the side walls. If the metal rings abut against such edges when the metal rings are held on the ring seats, the metal rings are likely to become damaged.

It is a general object of the present invention to provide a feed jig, which makes it easy to produce metal rings that are homogenous in their entirety.

A major object of the present invention is to provide a feed jig that is lighter in weight.

Another object of the present invention is to provide a feed jig, which makes it possible to reduce various costs.

Still another object of the present invention is to provide a feed jig, in which it is less likely for the metal rings to become damaged when the feed jig holds the metal rings.

Yet another object of the present invention is to provide a method of manufacturing the aforementioned feed jig.

Still another object of the present invention is to provide a method of heat-treating metal rings using the aforementioned feed jig.

According to an embodiment of the present invention, there is provided a feed jig for feeding a metal ring having an elastic recovering capability, comprising:

a base plate; and at least three holder shafts vertically mounted on the base plate and extending parallel to each other, wherein each of the holder shafts comprises a hollow body having a plurality of recesses defined in a side wall thereof, for holding the metal ring.

Since the holder shafts are constructed as hollow bodies, the holder shafts are less heavy than solid holder shafts. Therefore, the feed jig is less heavy and the electric power required to convey the feed jig is smaller. In other words, the feed jig is a power saver.

According to the present invention, the feed jig may further include a joint plate spaced from the base plate and joined to respective ends of all of the holder shafts. Therefore, the holder shafts, which hold the metal ring, are prevented from becoming tilted, and the metal ring is prevented from becoming dislodged from the holder shafts if the holder shafts otherwise are tilted.

Preferably, the holder shafts have respective interiors held in fluid communication with atmosphere. The base plate may have through holes defined therein, and interiors of the holder shafts may be held in fluid communication with atmosphere via such through holes. If the feed jig includes the joint plate, then the joint plate may also have through holes defined therein, and interiors of the holder shafts may be held in fluid communication with atmosphere via such through holes.

In this case, as described later, the temperature within and outside of the holder shafts is kept in substantial equilibrium when a heat treatment process is carried out. Consequently, the temperature of junctions between the holder shafts and the metal ring is prevented from dropping, and the metal ring can be heated substantially uniformly in its entirety. If the heat treatment process is a nitriding process, then the metal ring can be nitrided to a substantially uniform degree in its entirety.

According to another embodiment of the present invention, there is provided a method of manufacturing a feed jig for holding and feeding a metal ring having an elastic recovering capability, with recesses defined in side walls of at least three holder shafts, comprising the steps of:

performing a hydroforming process on hollow bodies in order to form recesses in side walls thereof, thereby producing hollow holder shafts; and mounting the holder shafts vertically on a base plate.

The hydroforming process may be replaced with a forming process using a die. More specifically, according to still another embodiment of the present invention, there is provided a method of manufacturing a feed jig for holding and feeding a metal ring having an elastic recovering capability, with recesses defined in side walls of at least three holder shafts, comprising the steps of:

pressing a die against inner walls of hollow bodies in order to raise a plurality of ridges on the side walls and form a plurality of recesses in the side walls between the ridges, thereby producing hollow holder shafts; and mounting the holder shafts vertically on a base plate.

In any case, the hollow bodies are shaped without chips, which would otherwise be produced if a holder shaft were produced by cutting a solid rod. Consequently, since no chips need to be thrown away, processing costs can be greatly reduced. Furthermore, raw materials can be used with increased efficiency. In addition, the hollow bodies are less expensive than solid rods and hence are advantageous in terms of cost.

To prevent the holder shafts from having edges, a hydroforming die or a die for raising ridges may have curved surfaces.

The method may further include joining respective ends of all of the holder shafts to a joint plate. Since the attitude of the holder shafts, which have been joined to the joint plate, is firmly maintained, the holder shafts, which hold the metal ring, are prevented from becoming tilted, and the metal ring is prevented from becoming dislodged from the holder shafts if the holder shafts otherwise are tilted.

According to yet another embodiment of the present invention, there is provided a method of heat-treating a metal ring having an elastic recovering capability, comprising the steps of:

holding the metal ring with recesses defined in side walls of at least three holder shafts of a feed jig, the holder shafts comprising hollow bodies, respectively;

introducing the feed jig, which holds the metal ring, into a heat treatment furnace; and heat-treating the metal ring in the heat treatment furnace while an atmospheric gas flows through the holder shafts.

An intensive study made by the inventor of the present invention has revealed that when a metal ring, which is held by solid holder shafts, is nitrided, the metal ring tends to become nitrided to varying degrees, due to the fact that the temperature of the solid holder shafts does not rise sufficiently. In other words, even when the temperature of the atmospheric gas around the solid holder shafts is high, it takes a long time for the temperature of the solid holder shafts to rise. When heat is transferred to the surface of a solid hollow shaft, such heat is then transferred to an inner region thereof, the temperature of which is lower than the surface. It is not the case that only the surface is heated to a high temperature. Rather, the inner region also needs to become high in temperature in order for the surface to become high in temperature.

Therefore, solid holder shafts, which have not yet been heated sufficiently to a high temperature, tend to abut against the metal ring. It is difficult to raise the temperature of junctions between the metal ring and such solid holder shafts. Even when the metal ring is nitrided in this state, the nitriding process does not progress sufficiently at such junctions.

According to the present invention, the holder shafts are hollow, and an atmospheric gas (e.g., a nitriding gas) flows through the holder shafts. Therefore, heat is transferred to the holder shafts via the atmospheric gas that resides within the holder shafts as well as the atmospheric gas outside of the holder shafts. The holder shafts thus quickly rise in temperature, and the temperature within and outside of the holder shafts is brought into substantial equilibrium.

As a result, the temperature of junctions between the metal ring and the holder shafts and the temperature of other regions are made substantially equal to each other. Stated otherwise, the temperature of the metal ring is made substantially uniform in its entirety.

In this state, when the metal ring is nitrided, nitriding progresses substantially uniformly throughout the entire metal ring. In other words, it is easy to obtain a homogeneous metal ring in which various properties thereof are substantially equal throughout the entirety of the metal ring.

According to yet still another embodiment of the present invention, there is provided a feed jig for feeding a plurality of metal rings having an elastic recovering capability, which are arranged in two vertical rows including a first row and a second row, comprising:

a base plate; and at least four holder shafts vertically mounted on the base plate and extending parallel to each other, each of the holder shafts having a plurality of annular ridges extending from a side wall thereof substantially perpendicularly to an axis of the holder shaft, wherein the holder shafts hold the metal rings with outer walls thereof inserted between adjacent ones of the annular ridges, wherein two of the four holder shafts hold both of the metal rings in the first row and the metal rings in the second row, and the remaining two of the four holder shafts hold either one of the metal rings in the first row or the metal rings in the second row.

The holder shafts are constructed as hollow bodies. Therefore, the holder shafts are less heavy than solid holder shafts. Plural rows of metal rings are held by common holder shafts. Therefore, the number of holder shafts is reduced. The feed jig thus is less heavy and the electric power required to convey the feed jig is smaller.

In addition, the hollow holder shafts are capable of transferring heat more efficiently than solid holder shafts. When the metal rings are heat-treated, the temperature of the feed jig, and hence the temperature of the metal rings held by the feed jig, can be increased with less heat energy. Consequently, electric power required to heat-treat the metal rings is smaller.

Therefore, according to the present invention, the feed jig is a power saver.

The annular ridges of the holder shafts may be formed by cutting outer walls of hollow cylindrical tubes. The hollow cylindrical tubes are highly inexpensive, and can be cut easily and simply by a known cutting apparatus. Therefore, the holder shafts can be fabricated inexpensively, or in other words, at a low cost.

Preferably, the holder shafts have respective interiors held in fluid communication with atmosphere. In this case, the base plate may have through holes defined therein, and interiors of the holder shafts may be held in fluid communication with atmosphere via such through holes.

In this case, as described later, the temperature both within and outside of the holder shafts is kept in substantial equilibrium when a heat treatment process is carried out. Consequently, the temperature of junctions between the holder shafts and the metal rings is prevented from dropping, and the metal rings can be heated substantially uniformly in their entirety. If the heat treatment process is a nitriding process, then the metal rings can be nitrided to a substantially uniform degree in their entirety.

Preferably, the holder shafts have respective surfaces with nickel layers formed thereon. The holder shafts may be made of nickel or a nickel-based alloy. Nickel functions as a barrier against diffusion of constituent elements of the holder shafts into the metal rings. Therefore, it is easy to obtain metal rings of good appearance (i.e., that are aesthetically pleasing).

In any case, the feed jig may hold the metal rings in an elliptical shape. In this case, the feed jig holds the metal rings while elastically deforming the metal rings. The metal rings thus are prevented from becoming elastically deformed in unexpected directions. Accordingly, the metal rings, which recover their original shape under elasticity, are prevented from being damaged by contact with other members or mechanisms, which also are prevented from being damaged by contact with the metal rings.

In this case, the metal rings have the same shorter diameter, although the metal rings have different dimensions. Consequently, all of the metal rings can be held by the holder shafts without inducing wobbling movements. The metal rings also are prevented from becoming plastically deformed.

The holder shafts thus are capable of the holding metal rings according to other standards (outside diameters), provided that the shorter diameters thereof are kept in agreement with each other. Stated otherwise, metal rings according to various standards can be dealt with for better versatility and flexibility.

According to a further embodiment of the present invention, there is provided a method of heat-treating a plurality of metal rings having an elastic recovering capability, which are arranged in two vertical rows including a first row and a second row, on a feed jig including a base plate and at least four holder shafts vertically mounted on the base plate and extending parallel to each other, each of the holder shafts having a plurality of annular ridges extending from a side wall substantially perpendicularly to an axis of the holder shafts, wherein the holder shafts hold the metal rings with outer walls of the metal rings being inserted between adjacent ones of the annular ridges, the method comprising the steps of:

holding both of the metal rings in the first row and the metal rings in the second row on two of the four holder shafts, and holding either one of the metal rings in the first row or the metal rings in the second row on a remaining two of the four holder shafts;

introducing the feed jig, which holds the metal rings, into a heat treatment furnace; and heat-treating the metal rings in the heat treatment furnace while an atmospheric gas flows in the holder shafts.

An intensive study made by the inventor of the present invention has revealed that when a metal ring, which is held by solid holder shafts, is nitrided, the metal ring tends to become nitrided in varying degrees due to the fact that the temperature of the solid holder shafts does not rise sufficiently. In other words, even when the temperature of atmospheric gas around the solid holder shafts is high, it takes a long time for the temperature of the solid holder shafts to rise. When heat is transferred to the surface of a solid hollow shaft, such heat is then transferred to an inner region, the temperature of which is lower than on the surface. It is not the case that only the surface is heated to a high temperature, but rather, the inner region also must become high in temperature in order to make the surface high in temperature.

Therefore, the solid holder shafts, which have not been sufficiently heated to a high temperature, tend to abut against the metal ring. It is difficult for junctions between the metal ring and the solid holder shafts to increase in temperature. In this state, even when the metal ring is nitrided, the nitriding process does not progress sufficiently at such junctions.

According to the present invention, the holder shafts are hollow, and atmospheric gas (e.g., a nitriding gas) flows through the holder shafts. Therefore, heat is transferred to the holder shafts from atmospheric gas within the holder shafts as well as atmospheric gas outside of the holder shafts. The holder shafts thus quickly rise in temperature, and the temperature within and outside of the holder shafts is brought into substantial equilibrium.

As a result, the temperature of junctions between the metal rings and the holder shafts and the temperature of other regions are made substantially equal to each other. Stated otherwise, the temperature of the metal rings is made substantially uniform in its entirety.

In this state, when the metal rings are nitrided, nitriding progresses substantially uniformly throughout the entire metal ring. In other words, it is easy to obtain homogeneous metal rings, various properties of which are substantially equal throughout the entirety of the metal rings.

Since the holder shafts are hollow and plural rows of metal rings are held by common holder shafts, the feed jig is less heavy, and the electric power required to convey the feed jig is smaller. The feed jig therefore is a power saver.

When the metal rings are heat-treated, the holder shafts preferably have respective interiors, which are held in fluid communication with the heat treatment furnace. Inlets for introducing the atmospheric gas into the holder shafts preferably are oriented upstream with respect to a direction along which the atmospheric gas flows. This arrangement makes it possible to introduce atmospheric gas into the holder shafts, and hence to bring the temperature both within and outside of the holder shafts quickly into equilibrium.

For reasons described above, it is preferable to feed and heat-treat the metal rings while the metal rings are held in an elliptical shape.

According to a still further embodiment of the present invention, there is provided a feed jig for holding a plurality of metal rings having an elastic recovering capability in a row with three or more metal ring holder members that extend parallel to each other, wherein:

each of the metal ring holder members comprises a columnar member having a polygonal cross-sectional shape as viewed in a longitudinal direction, and a side surface facing the metal rings;

each of the metal ring holder members has teeth for holding the metal rings, the teeth being disposed only on an end face that faces toward the metal rings; and the metal rings have outer circumferential edges gripped between adjacent ones of the teeth.

With the above arrangement, the metal ring holder members, which are contacted by the metal rings, are small in size and weight. Therefore, the metal ring holder members have a reduced thermal capacity.

As a result, the metal ring holder members exhibit good thermal followability during the heat treatment process, resulting in a reduction in the rate at which diameters of the metal rings change during the heat treatment process.

In addition, the metal ring holder members as well as the heat treatment jig are made lighter. Therefore, electric power required to convey the metal rings together with the feed jig can be saved.

In this case, the metal ring holder members preferably comprise hollow members, because as described above, such ring holder members allow the metal rings to be heat-treated substantially uniformly in their entirety.

The feed jig includes as many metal ring holder members as required to hold the metal rings in a plurality of rows, and thus, the number of jigs can be reduced.

DESCRIPTION OF EMBODIMENTS

Feed jigs and methods of manufacturing the same according to preferred embodiments of the present invention will be described in detail below with reference to the accompanying drawings, in relation to a method of heat-treating a metal ring using the feed jigs.

Figure 1:
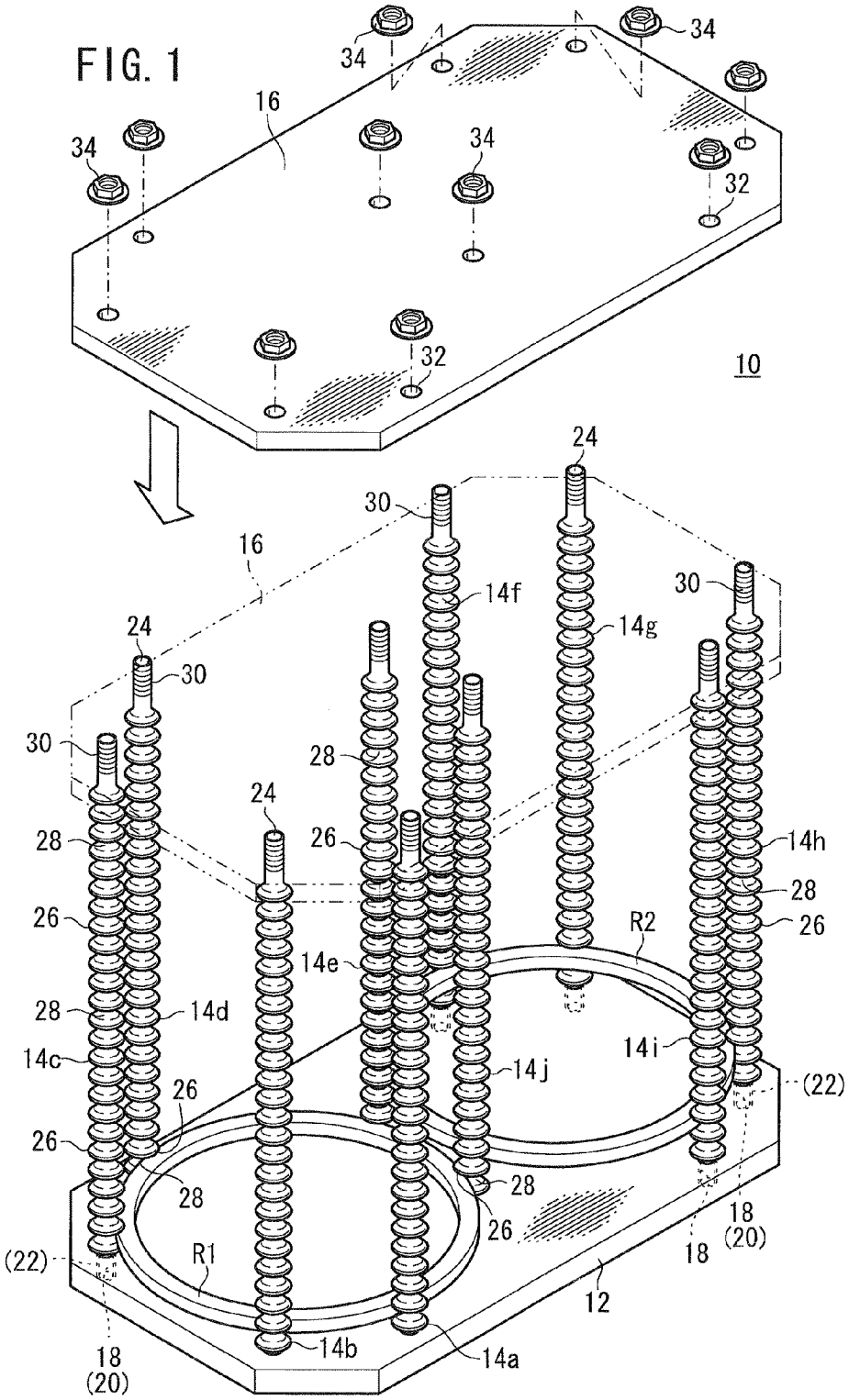
FIG. 1 is an overall schematic perspective view of a feed jig according to a first embodiment of the present invention.

FIG. 1 is an overall schematic perspective view of a feed jig 10 according to a first embodiment of the present invention. The feed jig 10 serves to hold and feed metal rings R1, R2. The feed jig 10 includes a base plate 12, ten holder shafts 14*a* through 14*j* vertically mounted on the base plate 12, and a joint plate 16, which is joined to all of the ten holder shafts 14*a* through 14*j*.

Although the holder shafts 14*a* through 14*j* are denoted by different reference characters for illustrative purposes, the holder shafts 14*a* through 14*j* are identical in structure. Similarly, although the metal rings R1, R2 are denoted by different reference characters, the metal rings R1, R2 are identical in structure.

Figure 2:
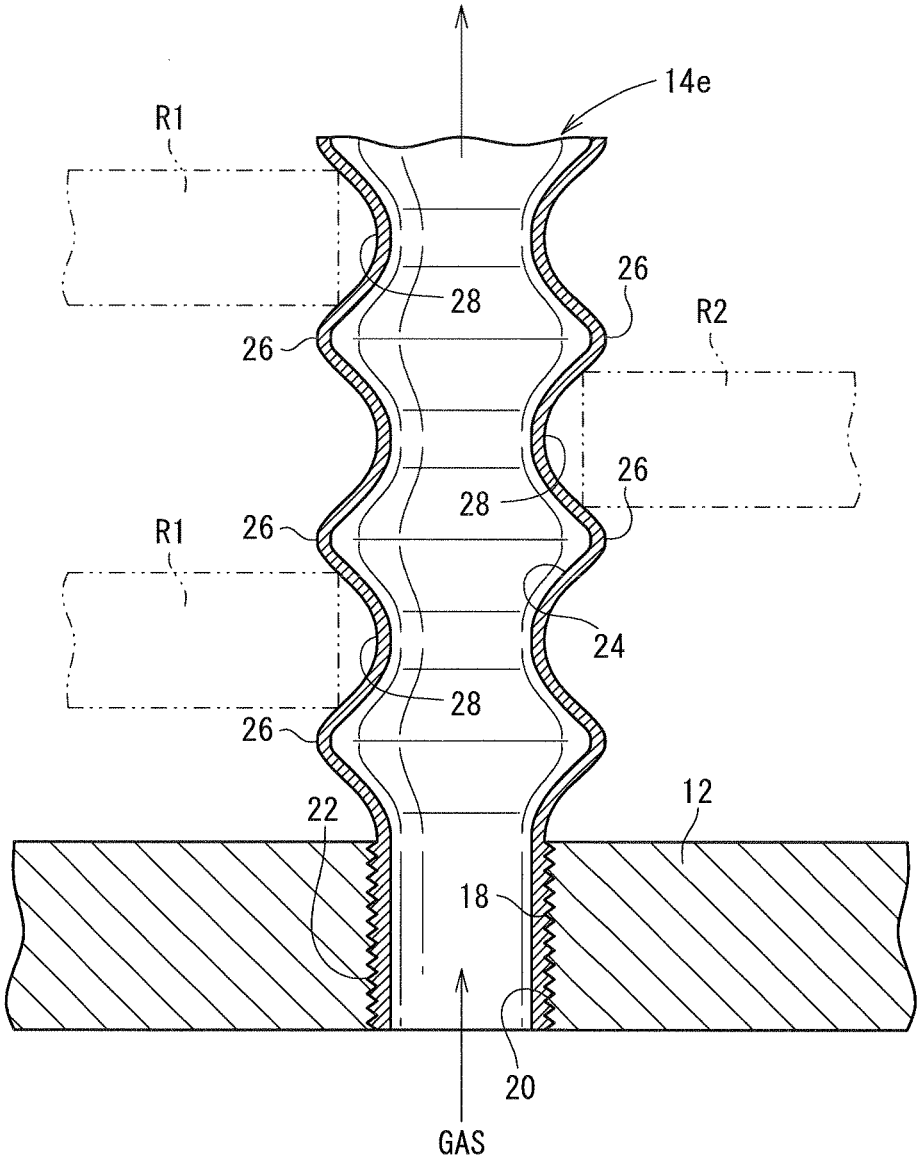
FIG. 2 is an enlarged fragmentary vertical cross-sectional view of the feed jig shown in FIG. 1.

The base plate 12 is in the form of a flat plate with isosceles right triangles cut off from longer sides to shorter sides thereof. As shown in FIG. 2, the base plate 12 has ten through holes 18, which extend along the thickness direction, with threads 20 defined on inner wall surfaces thereof.

The holder shafts 14*a* through 14*j* have lower end portions, with threads 22 defined on side surfaces thereof for threaded engagement with the threads 20. The holder shafts 14*a* through 14*j* are vertically mounted on the base plate 12, with the threads 22 thereof held in threaded engagement with the threads 20 of the base plate 12.

As shown in FIG. 2, which is a fragmentary vertical cross-sectional view of the holder shaft 14*e*, each of the holder shafts 14*a* through 14*j* is in the form of a hollow body with a space 24 defined axially therethrough. The space 24 functions as a passage for an atmospheric gas (e.g., a nitriding gas) to flow therethrough.

Each of the holder shafts 14*a* through 14*j* has a plurality of alternate ridges 26 and recesses 28 formed on a side wall thereof. The ridges 26 have vertexes defined by curved surfaces, and the recesses 28 have bottoms defined by curved surfaces. Therefore, the ridges 26 and the recesses 28 are free of sharp portions or edges.

As indicated by the imaginary lines in FIG. 2, the metal rings R1, R2 are positioned at the recesses 28 of the holder shaft 14*e*. As shown in FIG. 1, the holder shafts 14*a* through 14*j* are erected on the base plate 12 such that the recesses 28 thereof are positionally aligned with each other. The metal ring R1 is gripped by the recesses 28 of the holder shafts 14*a* through 14*e* and 14*j*, whereas the metal ring R2 is gripped by the recesses 28 of the holder shafts 14*e* through 14*j*. Among the holder shafts 14*a* through 14*j*, the two holder shafts 14*e* and 14*j* hold both of the metal rings R1, R2.

The holder shafts 14*a* through 14*j* have threads 30 on upper end portions thereof. The threads 30 extend respectively through ten through holes 32, which are defined and exposed in the joint plate 16.

The side walls of the holder shafts 14*a* through 14*j* have respective surfaces that are plated with nickel, thereby providing nickel covering layers. Alternatively, instead of nickel covering layers, the holder shafts 14*a* through 14*j* themselves may be made of nickel.

The joint plate 16 is substantially identical in structure to the base plate 12, except that the through holes 32 do not have threads therein. The joint plate 16 also is in the form of a flat plate with isosceles right triangles cut off from longer sides to shorter sides thereof.

As can easily be understood from FIG. 1, the holder shafts 14*a* through 14*j* are interposed between the base plate 12 and the joint plate 16. Therefore, the joint plate 16 is spaced from the base plate 12 by a distance that is substantially the same as the axial length of the holder shafts 14*a* through 14*j*.

Washered nuts 34 are threaded respectively over the threads 30 of the holder shafts 14*a* through 14*j*, which extend through and are exposed from the through holes 32 in the joint plate 16, thereby joining all of the holder shafts 14*a* through 14*j* to the joint plate 16.

As can be understood from the foregoing, both ends of the holder shafts 14*a* through 14*j* are not closed, but rather, interiors (spaces 24) of the holder shafts 14*a* through 14*j* are held in fluid communication with atmosphere.

A method of manufacturing the feed jig 10 will be described below, in relation to a method of heat-treating the metal rings R1, R2.

First, the holder shaft 14*a*, including the ridges 26 and the recesses 28 on a side wall thereof, is fabricated. The holder shaft 14*a* may be fabricated by hydroforming.

Figure 3:
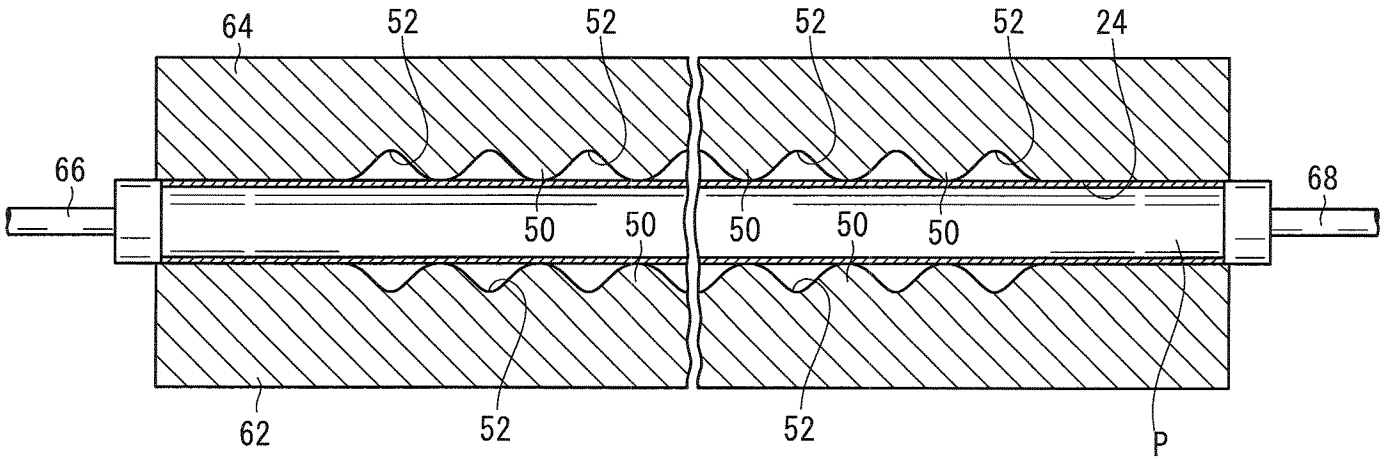
FIG. 3 is a schematic vertical cross-sectional view showing the manner in which a tube, which serves as a raw material that forms a holder shaft, is set in a shaping die.

As shown in FIG. 3, a hollow pipe P is set into forming dies 62, 64 comprising ridges 50 with curved vertexes, and recesses 52 with curved bottoms.

Figure 4:
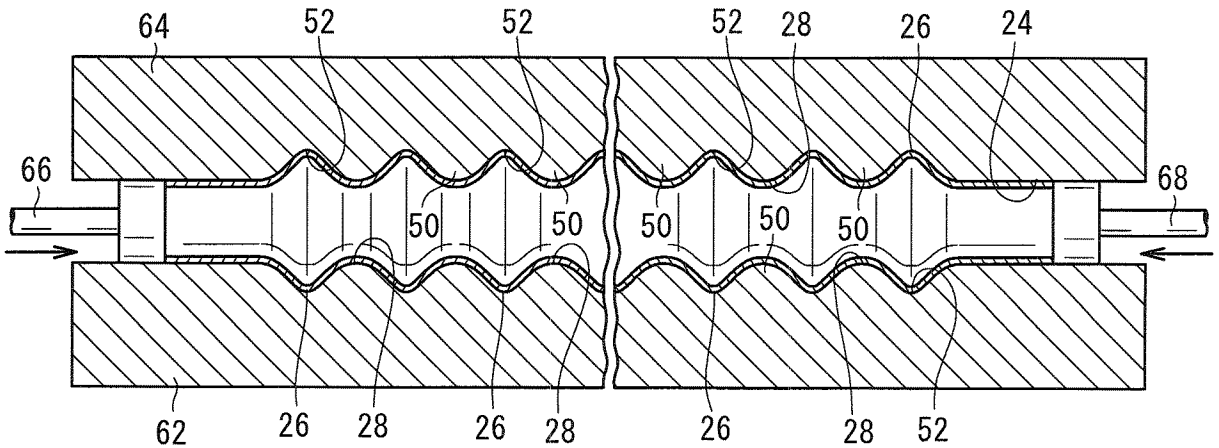
FIG. 4 is a schematic vertical cross-sectional view showing the manner in which ridges and recesses are formed on a side wall of the tube by the shaping die shown in FIG. 3.

Thereafter, the interior (space 24) of the pipe P is filled with a liquid such as water or the like. As shown in FIG. 4, pressing forces are applied to the pipe P from opposite ends thereof by a set of pushers 66, 68, thereby shaping the side wall of the pipe P along the ridges 50 and the recesses 52 of the forming dies 62, 64. Thus, recesses 28 and ridges 26 are formed at positions corresponding to the ridges 50 and the recesses 52. Since the vertexes of the ridges 50 and the bottoms of the recesses 52 of the forming dies 62, 64 are curved, the vertexes of the ridges 26 and the bottoms of the recesses 28, which are formed by copying the shape of the ridges 50 and the recesses 52, also are curved. Accordingly, no edges are formed on the pipe P.

Then, the forming dies 62, 64 are opened to expose the pipe P. Next, threads 22, 30 are formed on respective ends of the pipe P, thereby producing the holder shaft 14*a*.

Figure 5:
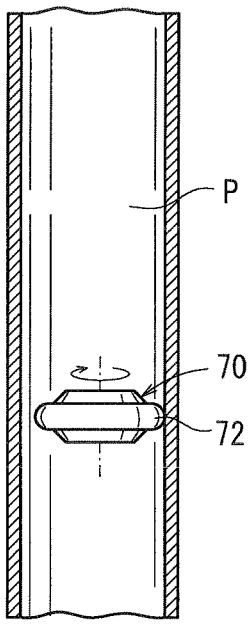
FIG. 5 is a schematic vertical cross-sectional view showing the manner in which a rotating die is placed in a holder shaft.

Alternatively, as shown in FIG. 5, a rotating die 70, which can be inserted in the interior (space 24) of the pipe P, may be employed. The rotating die 70 has a maximum diameter, which is smaller than the inside diameter of the pipe P. The rotating die 70 can be rotated by a rotating mechanism, not shown.

The rotating die 70 has a large-diameter portion 72 located substantially in the middle thereof along the heightwise direction. The large-diameter portion 72 has a curved side wall. As shown in FIG. 5, while being rotated, the rotating die 70 is displaced toward the pipe P, until finally the large-diameter portion 72 presses the pipe P from the inner wall surface thereof. The rotational center of the rotating die 70 is moved relatively toward the center of the pipe P, thereby causing the large-diameter portion 72 to press the inner wall surface of the pipe P along the circumferential direction thereof. As a result, a ridge 26 is formed, which is raised along the circumferential direction of the side wall of the pipe P.

Figure 6:
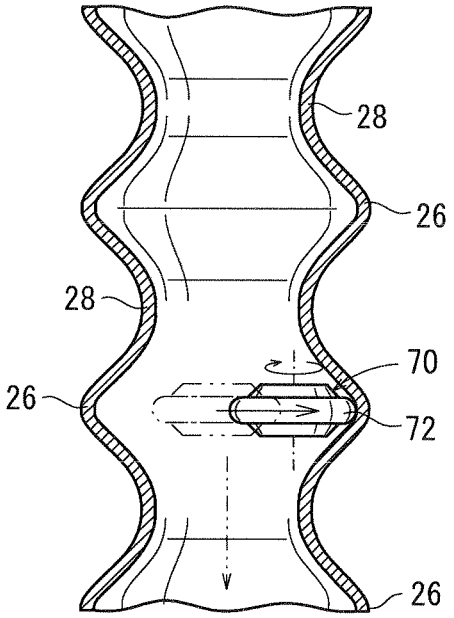
FIG. 6 is a schematic vertical cross-sectional view showing the manner in which a side wall of the tube is raised from inside by the rotating die shown in FIG. 5.

When the center of the rotating die 70 is displaced toward the center of the pipe P, the rotating die 70 is retracted from the inner wall surface of the pipe P. Then, the rotating die 70 is displaced along the axial direction of the pipe P. Thereafter, the above operation is repeated in order to form a plurality of ridges 26, as shown in FIG. 6.

Recesses 28 are formed between adjacent ones of the ridges 26. In other words, the ridges 26 and the recesses 28 are disposed alternately with respect to each other. Since the side wall of the large-diameter portion 72 is curved, vertexes of the ridges 26 and bottoms of the recesses 28 of the pipe P are defined by curved surfaces. Accordingly, the pipe P is free of edges.

Subsequently, threads 22, 30 are formed on respective ends of the pipe P, thereby producing the holder shaft 14*a*.

The remaining holder shafts 14*b* through 14*j* are fabricated by hydroforming, or by forming with the rotating die 70.

In the first embodiment, as described above, the hollow pipe P is shaped to provide the ridges 26 and the recesses 28. The hollow pipe P is shaped without chips, which would otherwise be produced according to the background art if the holder shaft were produced by cutting the side wall of a solid rod in order to provide such ridges and recesses. Consequently, raw materials can be used efficiently, and processing costs required to dispose of chips is lowered.

In addition, the hollow pipe P is less expensive than solid rods, which have the same diameter and length as the hollow pipe P. Therefore, the cost of the raw material used to make the holder shafts 14*a* through 14*j* is lowered.

The holder shafts 14*a* through 14*j* thus fabricated are plated with nickel, and thereafter, the holder shafts 14*a* through 14*j* are vertically mounted on the base plate 12. More specifically, the threads 22 formed on the ends of the holder shafts 14*a* through 14*j* are threaded into the threads 20 formed in the inner walls of the through holes 18 in the base plate 12 (see FIG. 2). If the holder shafts 14*a* through 14*j* are made of nickel, then the holder shafts 14*a* through 14*j* do not need to be plated with nickel.

Then, before the holder shafts 14*a* through 14*j* are joined by the joint plate 16, the metal rings R1, R2 are held by the holder shafts 14*a* through 14*j*.

The metal rings R1, R2 are fabricated by cutting a cylindrical drum of maraging steel into a preform having a prescribed width, and have an elastic recovering capability against pressing forces. More specifically, when the metal rings R1, R2 are released from such pressing forces, they are restored to their original shape under elasticity.

A plurality of metal rings R1 thus constructed are gripped on outer circumferential walls thereof by a gripping device, not shown. At this time, the gripping device applies gripping forces (pressing forces) to the metal rings R1 in order to deform all of the metal rings R1 simultaneously into an elliptical shape. Stated otherwise, the metal rings R1 are gripped by the gripping device while being deformed into an elliptical shape. The metal rings R1 are deformed within an elastic region thereof.

Figure 7:
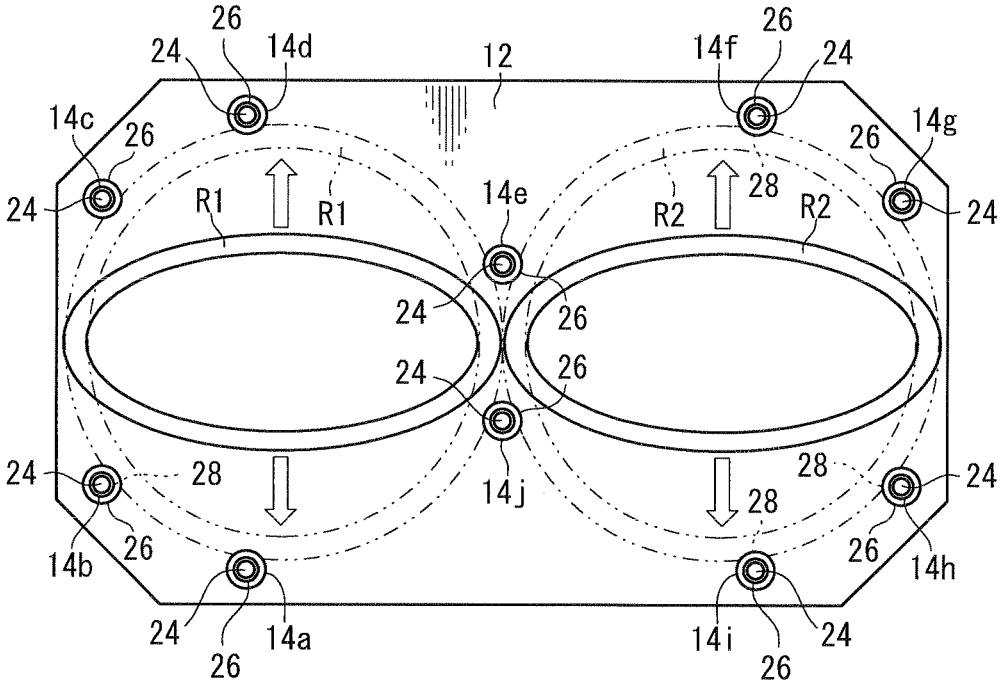
FIG. 7 is a plan view schematically showing the manner in which metal rings, which are deformed into elliptical shapes, are delivered to positions between holder shafts.

As shown in FIG. 7, the metal rings R1, which have been deformed into an elliptical shape, are delivered to positions between the holder shafts 14*a* through 14*e* and 14*j*. The gripping device is stopped at a position where the metal rings R1 are placed between the recesses 28.

Thereafter, all of the metal rings R1 are simultaneously released from the gripping forces applied by the gripping device, whereupon the metal rings R1 are restored to their original substantially circular shape under elastic recovering forces, as indicated by the imaginary lines in FIG. 7. At this time, the metal rings R1 engage within the recesses 28 of the holder shafts 14*a* through 14*e* and 14*j*. As a result, the metal rings R1 are simultaneously held by the holder shafts 14*a* through 14*e* and 14*j*.

Then, the gripping device simultaneously grips a plurality of metal rings R2 and deforms the metal rings R2 into an elliptical shape. The gripping device then delivers the deformed metal rings R2 to positions between the holder shafts 14*e* through 14*j*. Subsequently, in the manner described above, the gripping device is stopped at a position where the rings R2 are placed between the recesses 28, whereupon all of the metal rings R2 are simultaneously released from the gripping forces applied by the gripping device. When the metal rings R2 are released, the metal rings R2 are restored to their original substantially circular shape, and outer walls engage within the recesses 28 of the holder shafts 14*e* through 14*j*. As a result, the metal rings R2 are held by the holder shafts 14*e* through 14*j*. As shown in FIG. 2, the metal rings R1, R2 are held in staggered positions out of physical interference with each other.

As described above, vertexes of the ridges 26 and bottoms of the recesses 28 of the holder shafts 14*a* through 14*j* are defined by curved surfaces, and hence are free of edges. Therefore, when the metal rings R1, R2, which have been deformed into an elliptical shape, are restored to their original shape, they are not damaged, as the metal rings R1, R2 do not come into contact or hit against any edges.

Since the vertexes of the ridges 26 and the bottoms of the recesses 28 of the holder shafts 14*a* through 14*j* are defined by curved surfaces, the metal rings R1, R2 are easily prevented from becoming damaged.

Figure 8:
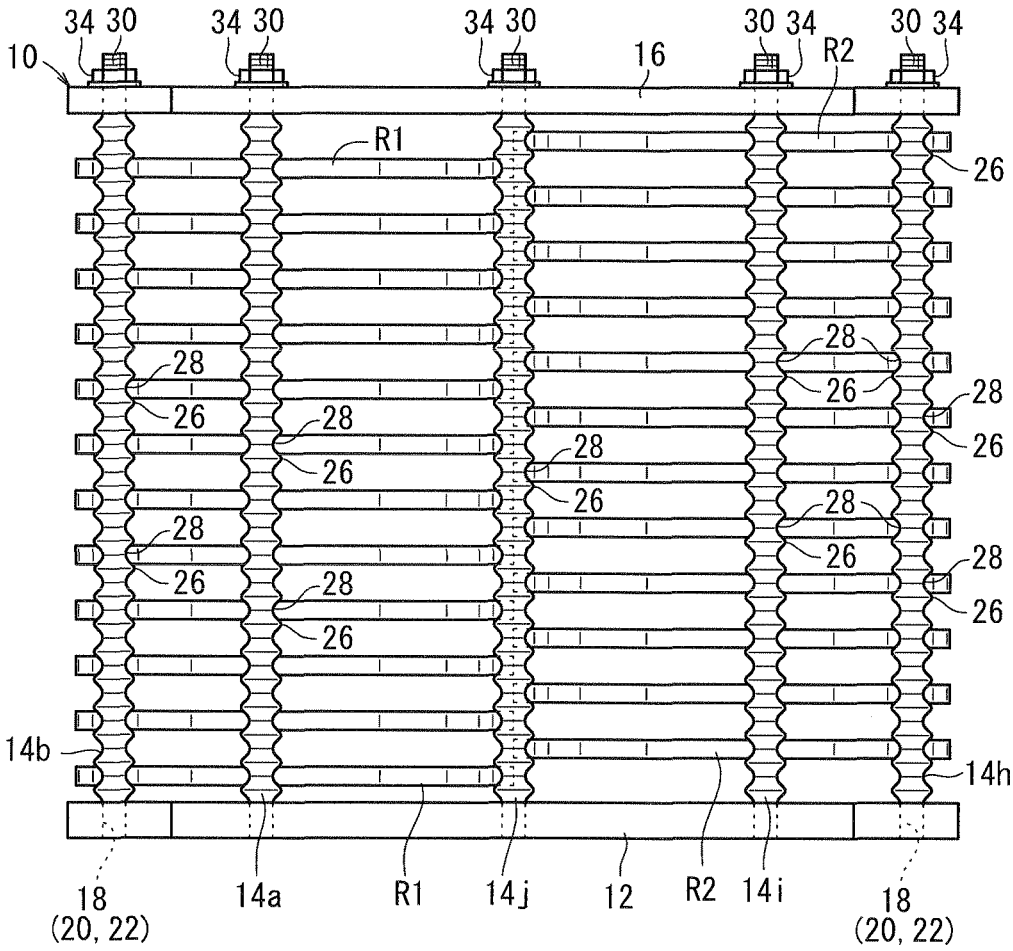
FIG. 8 is an overall schematic side elevational view showing the manner in which holder shafts, which hold metal rings, are joined to joint plates.
Figure 9:
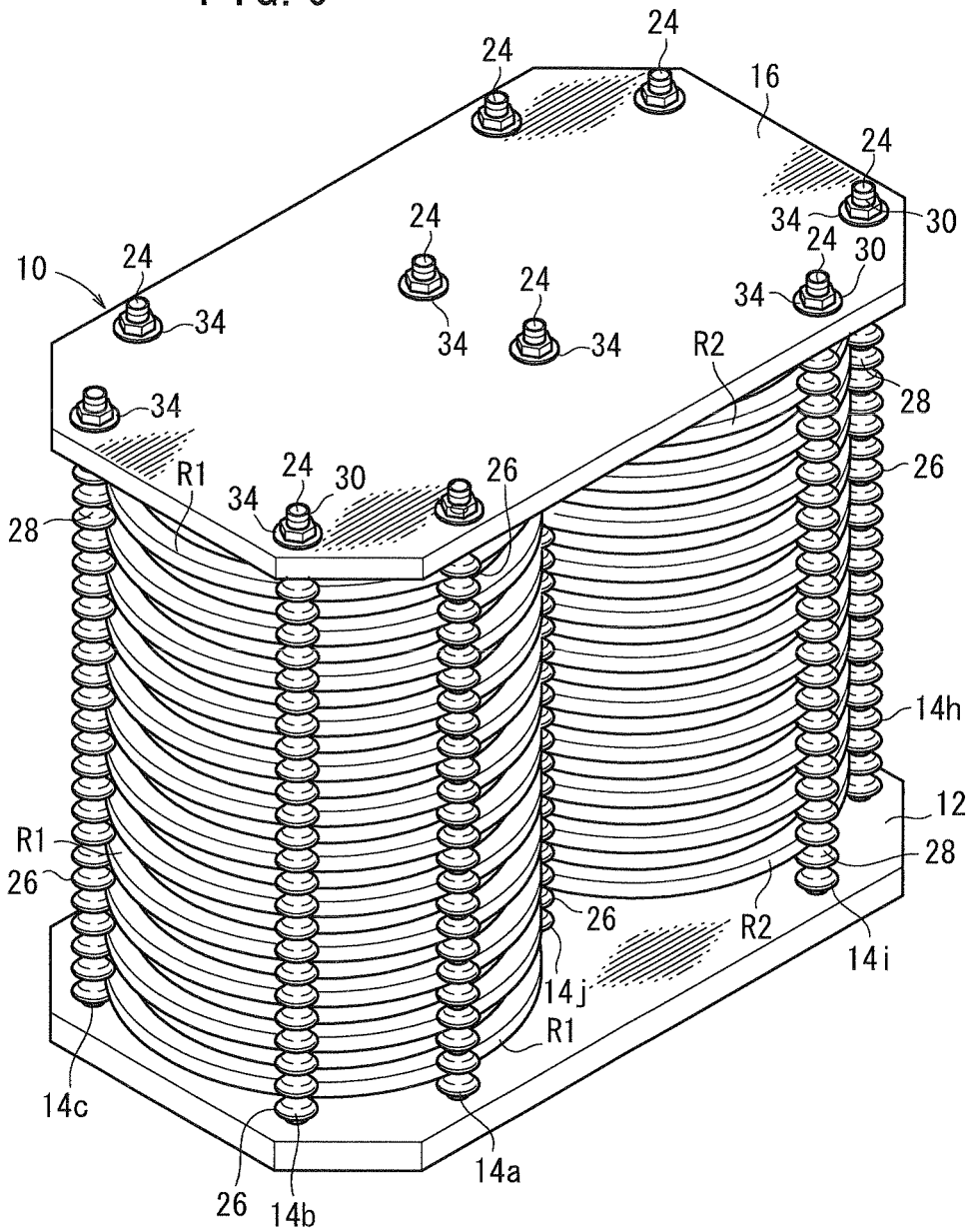
FIG. 9 is an overall schematic perspective view showing the manner in which the holder shafts, which hold the metal rings, are joined to the joint plates.

When the metal rings R1, R2 are held as described above, upper end portions with the threads 30 of the holder shafts 14*a* through 14*j* are inserted through the through holes 32 in the joint plate 16. Thereafter, the washered nuts 34 are threaded over the threads 30, which are exposed from the through holes 32, thereby placing the metal rings R1, R2 and the feed jig 10 in the state shown in FIGS. 8 and 9. Since the joint plate 16 is joined to the holder shafts 14*a* through 14*j*, the holder shafts 14*a* through 14*j* are prevented from tilting, and the metal rings R1, R2 are prevented from becoming dislodged from the holder shafts 14*a* through 14*j* if the holder shafts 14*a* through 14*j* otherwise are tilted.

In order to join the joint plate 16 to the holder shafts 14*a* through 14*j* after the metal rings R1, R2 have been held by the holder shafts 14*a* through 14*j*, it is possible to use a gripping device, which is of a simple structure. Although it is necessary to use a gripping device, which is of a slightly more complex structure than such a gripping device, and to perform a somewhat strict control process for delivering the metal rings R1, R2, the metal rings R1, R2 may be held by the holder shafts 14*a* through 14*j* after the joint plate 16 has been joined to the holder shafts 14*a* through 14*j*. In this case, the metal rings R1, R2 may be inserted between any adjacent two of the holder shafts 14*a* through 14*j*.

Figure 10:
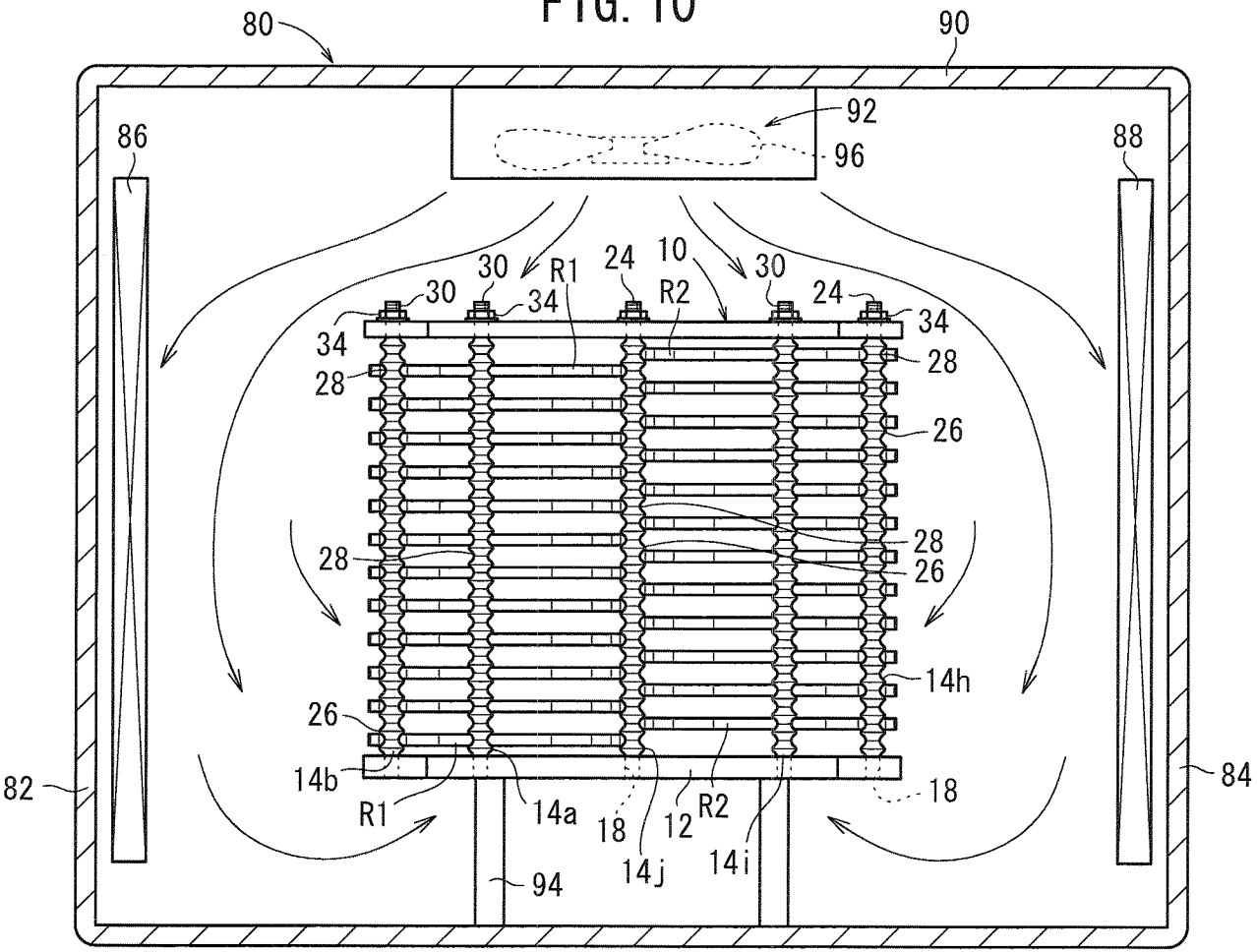
FIG. 10 is a front elevational view, partially in vertical cross section, showing the manner in which the feed jig is introduced into a heat treatment furnace.

Then, the metal rings R1, R2 together with the feed jig 10 are fed into the heat treatment furnace 80 shown in FIG. 10. As a consequence, the interiors (spaces 24) of the hollow holder shafts 14*a* through 14*j* and the interior of the heat treatment furnace 80 are placed in fluid communication with each other. The heat treatment furnace 80 is elongate along a direction in which the feed jig 10 is fed, and includes heaters 86, 88 disposed inwardly of side walls 82, 84 thereof, and a convection fan 92 mounted on a ceiling wall 90.

The feed jig 10 is fed into the heat treatment furnace 80 by a transfer mechanism, not shown. As described above, since the holder shafts 14*a* through 14*j* of the feed jig 10 are hollow, the feed jig 10 is lighter than a feed jig according to the background art, which is made up of solid holder shafts. Therefore, it is easy to convey the feed jig 10, and the electric power required to convey the feed jig 10 can be saved.

The feed jig 10 is supported on the transfer mechanism by a placement jig 94. The feed jig 10 is placed on the placement jig 94 such that the through holes 18 in the base plate 12 are not closed by the placement jig 94.

A nitriding process, which serves as a heat treatment process, will be described below by way of example. The heat treatment furnace 80 shown in FIG. 10 is supplied with a nitriding gas such as ammonia or the like. The nitriding gas is heated by the heaters 86, 88 to a temperature at which the metal rings R1, R2 can be nitrided, e.g., about 500° C.

The nitriding gas, the temperature of which has increased, flows upwardly toward the ceiling wall 90 of the heat treatment furnace 80. According to the first embodiment, the convection fan 92 is actuated in order to rotate agitating vanes 96, for thereby inducing convection in the nitriding gas in the heat treatment furnace 80. Therefore, the nitriding gas descends along the side walls and ascends again near the placement jig 94 and the feed jig 10.

As described above, the spaces 24, i.e., the interiors of the holder shafts 14*a* through 14*j*, are held in fluid communication with the interior of the heat treatment furnace 80. Consequently, as shown in FIGS. 2 and 10, nitriding gas flows through the interiors (spaces 24) of the holder shafts 14*a* through 14*j* toward the ceiling wall 90 of the heat treatment furnace 80.

While the nitriding gas, the temperature of which has increased, flows through the interiors (spaces 24) of the holder shafts 14*a* through 14*j*, nitriding gas, the temperature of which is substantially the same as the temperature of the nitriding gas in the holder shafts 14*a* through 14*j*, also exists outside the holder shafts 14*a* through 14*j*. In other words, the nitriding gas is present both within and outside of the holder shafts 14*a* through 14*j* at substantially the same temperature. Therefore, the temperature both within and outside of the holder shafts 14*a* through 14*j* is kept in equilibrium, thereby making the temperature of the metal rings R1, R2 substantially uniform in its entirety. Stated otherwise, the temperature at junctions between the holder shafts 14*a* through 14*j* and the metal rings R1, R2 is substantially the same as the temperature of other regions of the metal rings R1, R2.

Nitriding gas enters into the metal rings R1, R2 from the surface thereof and then is diffused into the metal rings R1, R2, thereby forming nitrided layers on surfaces of the metal rings R1, R2. In other words, nitriding progresses within the metal rings R1, R2. The nitrided layers serve to harden the metal rings R1, R2.

As described above, the temperature of the metal rings R1, R2 is substantially uniform in its entirety. Therefore, nitriding progresses at substantially the same rate throughout the entirety of the metal rings R1, R2. Nitriding is thus prevented from progressing irregularly, and hence the thickness of the nitrided layers and hardening of the metal rings R1, R2 are prevented from becoming irregular.

According to the first embodiment, in which the holder shafts 14*a* through 14*j* are hollow and interiors thereof are held in fluid communication with atmosphere, it is possible for a nitriding gas to flow through the holder shafts 14*a* through 14*j* when the metal rings R1, R2 are nitrided. Since the temperature both within and outside of the holder shafts 14*a* through 14*j* is kept in equilibrium, the temperature at junctions between the metal rings R1, R2 and the holder shafts 14*a* through 14*j* is substantially the same as the temperature of other regions of the metal rings R1, R2. Accordingly, the metal rings R1, R2 are hardened substantially uniformly in their entirety.

Inasmuch as a nickel covering layer is formed on surfaces of the side walls of the holder shafts 14*a* through 14*j*, constituent elements of the holder shafts 14*a* through 14*j* are prevented from becoming diffused into the metal rings R1, R2 during the nitriding process. In other words, the nickel covering layer functions as a barrier for preventing diffusion of constituent elements of the holder shafts 14*a* through 14*j* into the metal rings R1, R2. The same holds true if the holder shafts 14*a* through 14*j* themselves are made of nickel.

After the metal rings R1, R2 have been nitrided, the feed jig 10 is unloaded from the heat treatment furnace 80. Thereafter, the washered nuts 34 and the joint plate 16 are detached from the holder shafts 14*a* through 14*j*, thereby exposing the metal rings R1, R2.

The exposed metal rings R1, R2 are gripped by the gripping device, detached from the holder shafts 14*a* through 14*j* while deformed in an elliptical shape, and fed to a given station or storage site. When released from the gripping device, the metal rings R1, R2 are restored to their original substantially circular shape under elastic recovering forces thereof.

For subsequently holding other new metal rings R1, R2, the feed jig 10, which includes the holder shafts 14*a* through 14*j* fabricated as described above, can be used repeatedly.

The base plate 12 and the joint plate 16 may have through holes in order to lighten the weight thereof, as with a joint plate 116 (see FIG. 11), to be described later.

In the first embodiment, the feed jig 10 is constructed so as to be capable of holding two parallel rows of metal rings R1, R2. However, the feed jig may also be constructed so as to be capable of holding three or more rows of metal rings, or only one row of metal rings.

A second embodiment will be described below.

Figure 11:
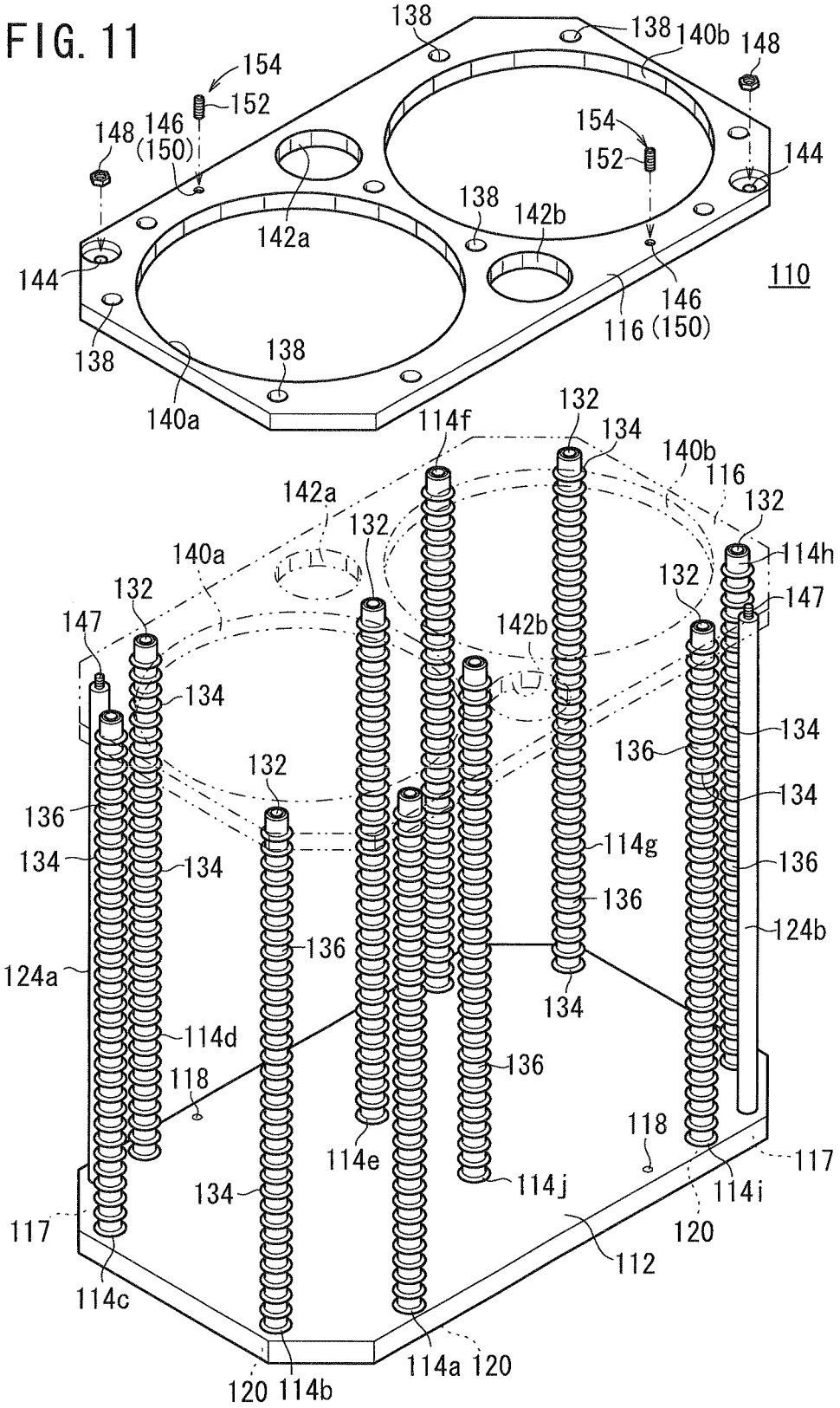
FIG. 11 is an overall schematic perspective view of a feed rack according to a second embodiment of the present invention.
Figure 12:
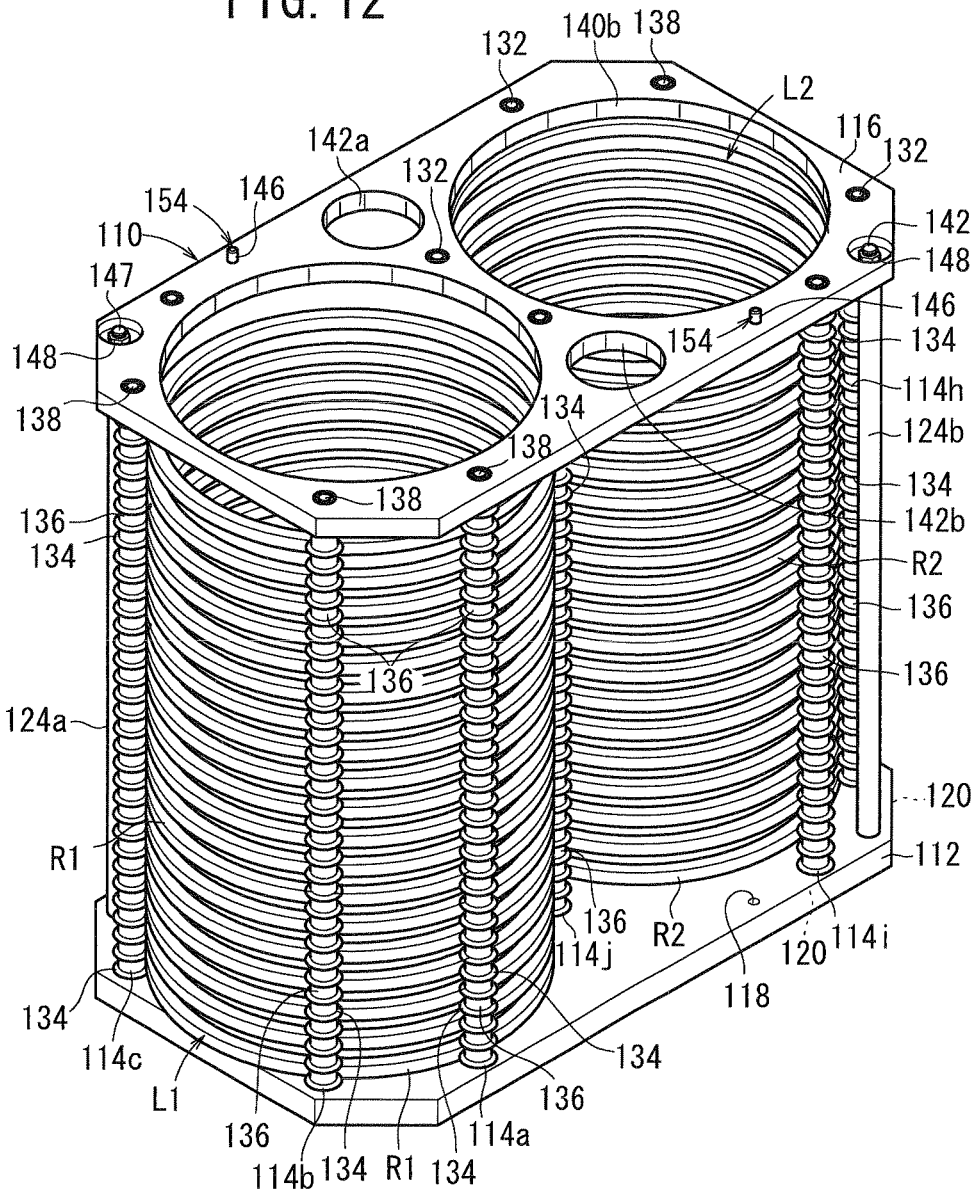
FIG. 12 is an overall schematic perspective view showing the manner in which two rows of metal rings are held by the feed rack shown in FIG. 11.

FIG. 11 is an overall schematic perspective view of a feed jig 110 according to a second embodiment of the present invention. FIG. 12 is an overall schematic perspective view showing the manner in which metal rings R1, R2 are held by the feed jig 110. The feed jig 110 serves to hold and feed a first row L1 of metal rings R1 and a second row L2 of metal rings R2. The feed jig 110 includes a base plate 112, ten holder shafts 114*a* through 114*j* vertically mounted on the base plate 112, and a joint plate 116, which is joined to all of the ten holder shafts 114*a* through 114*j*.

Although the holder shafts 114*a* through 114*j* have been denoted by different reference characters for illustrative purposes, the holder shafts 114*a* through 114*j* are identical in structure. Similarly, although the metal rings R1, R2 have been denoted by different reference characters, the metal rings R1, R2 are identical in structure.

Figure 13:
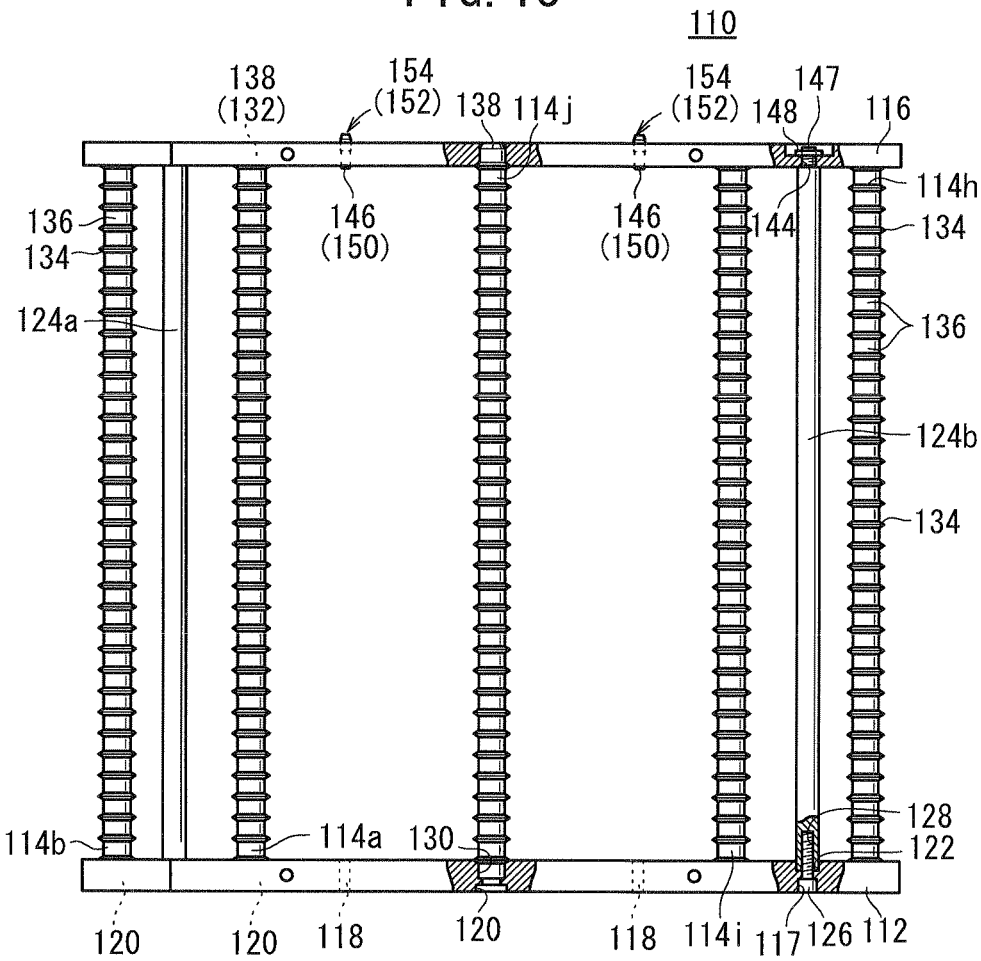
FIG. 13 is a side elevational view, partially in vertical cross section, of the feed rack shown in FIG. 11.

The base plate 112 is in the form of a flat plate, with isosceles right triangles cut off from longer sides to shorter sides thereof. As shown in FIG. 13, the base plate 112 has two bolt insertion holes 117, two joint pin insertion holes 118, and ten through holes 120 that extend along the thickness direction thereof.

As shown in FIG. 13, the bolt insertion holes 117 comprise steps 122 having a reduced inside diameter. Column members 124*a*, 124*b*, which are inserted into the bolt insertion holes 117 from openings thereof that face the joint plate 116 (upwardly in FIG. 13), have lower end faces seated on the steps 122. Bolts 126 are inserted into the bolt insertion holes 117 from lower openings thereof, as shown in FIG. 13. The bolts 126 are threaded into threaded holes 128, which are defined in lower end portions of the column members 124*a*, 124*b*, thereby fastening the column members 124*a*, 124*b* vertically to the base plate 112.

Figure 14:
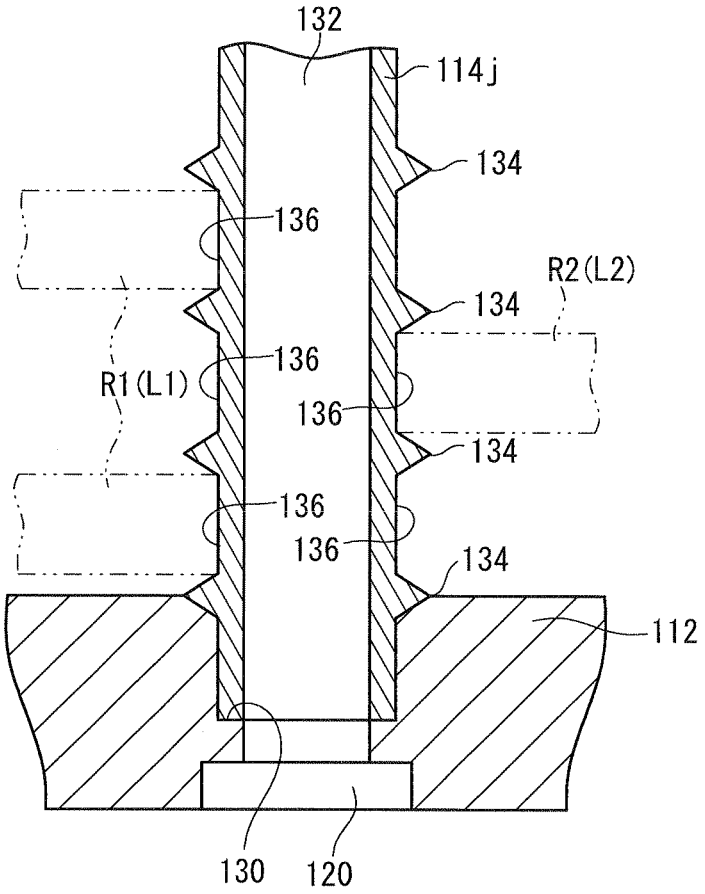
FIG. 14 is an enlarged fragmentary vertical cross-sectional view of the feed rack shown in FIG. 11.

As shown in FIG. 14, the through holes 120 also comprise steps 130 having a reduced inside diameter. The holder shafts 114*a* through 114*j*, which are inserted into the through holes 120 from openings thereof that face the joint plate 116 (upwardly in FIGS. 13 and 14), have lower end faces seated on the steps 130. When the lower end portions of the holder shafts 114*a* through 114*j* are inserted and fitted into the through holes 120, the holder shafts 114*a* through 114*j* are vertically mounted on the base plate 112.

FIG. 14 shows the holder shaft 114*j* partially in vertical cross section. As can be understood from such a vertical cross section, the holder shafts 114*a* through 114*j* are hollow bodies with spaces 132 defined axially therethrough. As described later, the spaces 132 function as passages for an atmospheric gas (e.g., a nitriding gas), which flows through the holder shafts 114*a* through 114*j*. Atmospheric gas is introduced into the space 132 through an inlet, which is provided at a lower opening of the through hole 120, as shown in FIG. 14.

The holder shafts 114*a* through 114*j* have annular ridges 134 that project from the side walls thereof in directions perpendicular to the axial direction of the holder shafts 114*a* through 114*j*. The annular ridges 134 have distal end surfaces, which are formed as V-shaped tapered slanted surfaces. As a result of forming the annular ridges 134, the holder shafts 114*a* through 114*j* also are provided with concave ring holders 136 disposed between adjacent ones of the annular ridges 134.

Each of the holder shafts 114*a* through 114*j* may be fabricated by cutting a hollow cylindrical tube from an outer wall portion thereof. More specifically, the side wall of a hollow cylindrical tube, which has a large thickness, is cut at a prescribed width. Such a cutting process is repeated at given intervals in order to produce each of the holder shafts 114*a* through 114*j*. The cut regions serve as the ring holders 136, whereas the uncut regions serve as the annular ridges 134.

As shown in FIG. 11, the holder shafts 114*a* through 114*j* are erected on the base plate 112 such that the annular ridges 134 thereof are positionally aligned with each other, and hence the ring holders 136 also are positionally aligned with each other. The metal rings R1 are gripped by the ring holders 136 of the holder shafts 114*a* through 114*e* and 114*j*, and the metal rings R2 are gripped by the ring holders 136 of the holder shafts 114*e* through 114*j*. Among the holder shafts 114*a* through 114*j*, the two holder shafts 114*e* and 114*j* hold both of the metal rings R1 and R2 (the first row L1, the second row L2).

The holder shafts 114*a* through 114*j* have respective upper end portions, which are inserted respectively into through holes 138 defined in the joint plate 116. Therefore, interiors (spaces 132) of the holder shafts 114*a* through 114*j* are not closed by the joint plate 116. As can be understood from the foregoing, both ends of the holder shafts 114*a* through 114*j* are not closed by the base plate 112 and the joint plate 116, but rather, the interiors (spaces 132) of the holder shafts 114*a* through 114*j* are held in fluid communication with atmosphere.

The side walls of the holder shafts 114*a* through 114*j* have respective surfaces plated with nickel, thereby providing nickel covering layers. Alternatively, instead of providing nickel covering layers, the holder shafts 114*a* through 114*j* themselves may be made of nickel.

Figure 15:
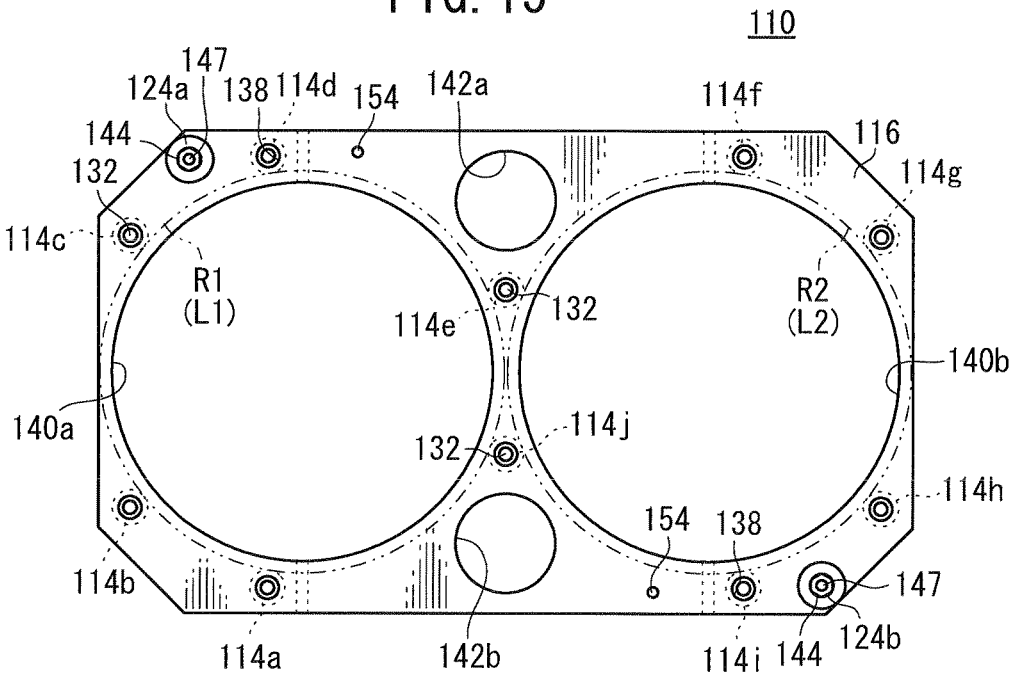
FIG. 15 is a plan view of the feed rack shown in FIG. 11.

The joint plate 116 also is in the form of a flat plate, with isosceles right triangles cut off from longer sides to shorter sides thereof. As shown in FIGS. 11 and 15, the joint plate 116 has larger circular openings 140*a*, 140*b* and smaller circular openings 142*a*, 142*b* defined therein, thereby making the joint plate 116 lighter in weight. As a result of the larger circular openings 140*a*, 140*b* and the smaller circular openings 142*a*, 142*b*, the joint plate 116 is made lighter in weight along with the feed jig 110.

The joint plate 116 has column member support holes 144 and joint pin fixing holes 146 defined therein at respective positions aligned with the bolt insertion holes 117. Joint pin insertion holes 118 are defined in the base plate 112. Threaded shafts 147 provided on distal ends of the column members 124*a*, 124*b* extend respectively through the column member support holes 144.

Nuts 148 are threaded over the respective threaded shafts 147, thereby joining the base plate 112 and the joint plate 116 to each other together with the column members 124*a*, 124*b*.

Threads 150 are disposed on inner walls of the joint pin fixing holes 146. Joint pins 154, which have threads 152 formed on side walls thereof, are threaded into the joint pin fixing holes 146. As described later, when the feed jigs 110 are stacked, the joint pins 154 are inserted into the joint pin insertion holes 118 in the base plate 112 of the upper feed jig 110.

The feed jig 110 according to the first embodiment is basically constructed as described above. Operations and advantages of the feed jig 110 will be described below in relation to a method of heat-treating the metal rings R1, R2 using the feed jig 110.

Before the joint plate 116 is joined to the holder shafts 114*a* through 114*j* and the column members 124*a*, 124*b*, the first rows L1 and second rows L2 of the metal rings R1, R2 are held by the holder shafts 114*a* through 114*j*. The holder shafts 114*a* through 114*j* and the column members 124*a*, 124*b* are vertically mounted on the base plate 112 as a result of being inserted respectively into the through holes 120 and the bolt insertion holes 117. As described above, the bolts 126 (see FIG. 13) are threaded into the threaded holes 128 defined in the column members 124*a*, 124*b*.

The metal rings R1, R2 are fabricated by cutting a cylindrical drum of maraging steel into a preform having a prescribed width. The metal rings R1, R2 exhibit an elastic recovering capability against pressing forces. More specifically, when the metal rings R1, R2 are released from such pressing forces, the metal rings R1, R2 are restored elastically to their original shape.

A plurality of metal rings R1 thus constructed are gripped at outer circumferential walls thereof by a gripping device, not shown. At this time, the gripping device applies gripping forces (pressing forces) to the metal rings R1, so as to deform all of the metal rings R1 simultaneously into an elliptical shape. Stated otherwise, the metal rings R1 are gripped by the gripping device while being deformed into an elliptical shape. The metal rings R1 are deformed within an elastic region thereof.

The metal rings R1, which have been deformed into an elliptical shape, are delivered to positions between the holder shafts 114*a* through 114*e* and 114*j*. The gripping device is stopped at a position where the metal rings R1 are placed between the ring holders 136 of the holder shafts 114*a* through 114*e* and 114*j*.

Thereafter, all of the metal rings R1 are simultaneously released from the gripping forces applied by the gripping device, whereupon the metal rings R1 are restored to their original substantially circular shape under elastic recovering forces thereof. At this time, the metal rings R1 engage within the ring holders 136 of the holder shafts 114*a* through 114*e* and 114*j*. As a result, the metal rings R1 are simultaneously held as the first row L1 by the holder shafts 114*a* through 114*e* and 114*j*, as shown in FIG. 12.

Then, the gripping device simultaneously grips a plurality of metal rings R2 and deforms the metal rings R2 into an elliptical shape. The gripping device then delivers the deformed metal rings R2 to positions located between the holder shafts 114*e* through 114*j*. Subsequently, in the same manner described above, the gripping device is stopped at a position where the rings R2 are placed between the ring holders 136 of the holder shafts 114*e* through 114*j*, whereupon all of the metal rings R2 are simultaneously released from the gripping forces applied by the gripping device. Once the metal rings R2 have been released, the metal rings R2 are restored to their original substantially circular shape, and outer walls thereof engage within the ring holders 136 of the holder shafts 114*e* through 114*j*. As a result, the metal rings R2 are held as the second row L2 by the holder shafts 114*e* through 114*j*. The metal rings R1, R2 are held in staggered positions out of physical interference with each other.

When the metal rings R1, R2 are held as described above, upper end portions of the holder shafts 114*a* through 114*j* are inserted through the through holes 138 in the joint plate 116. At the same time, the threaded shafts 147 of the column members 124*a*, 124*b* are inserted through the column member support holes 144. Thereafter, the nuts 148 are threaded over the threaded shafts 147. If necessary, the joint pins 154 are threaded into the joint pin fixing holes 146.

The metal rings R1, R2 and the feed jig 110 are placed in the state shown in FIG. 12. Since the joint plate 116 is joined to the holder shafts 114*a* through 114*j*, the holder shafts 114*a* through 114*j* are prevented from becoming tilted, and the metal rings R1, R2 are prevented from becoming dislodged from the holder shafts 114*a* through 114*j* if the holder shafts 114*a* through 114*j* otherwise are tilted.

In order to join the joint plate 116 to the holder shafts 114*a* through 114*j* after the metal rings R1, R2 have been held by the holder shafts 114*a* through 114*j*, it is possible to use a gripping device that is simple in structure. Although it is necessary to use a gripping device, which is of a slightly more complex structure than such a gripping device, and to perform a somewhat strict control process for delivering the metal rings R1, R2, the metal rings R1, R2 may be held by the holder shafts 114*a* through 114*j* after the joint plate 116 has been joined to the holder shafts 114*a* through 114*j*. In this case, the metal rings R1, R2 may be inserted between any adjacent two of the holder shafts 114*a* through 114*j*.

Figure 16:
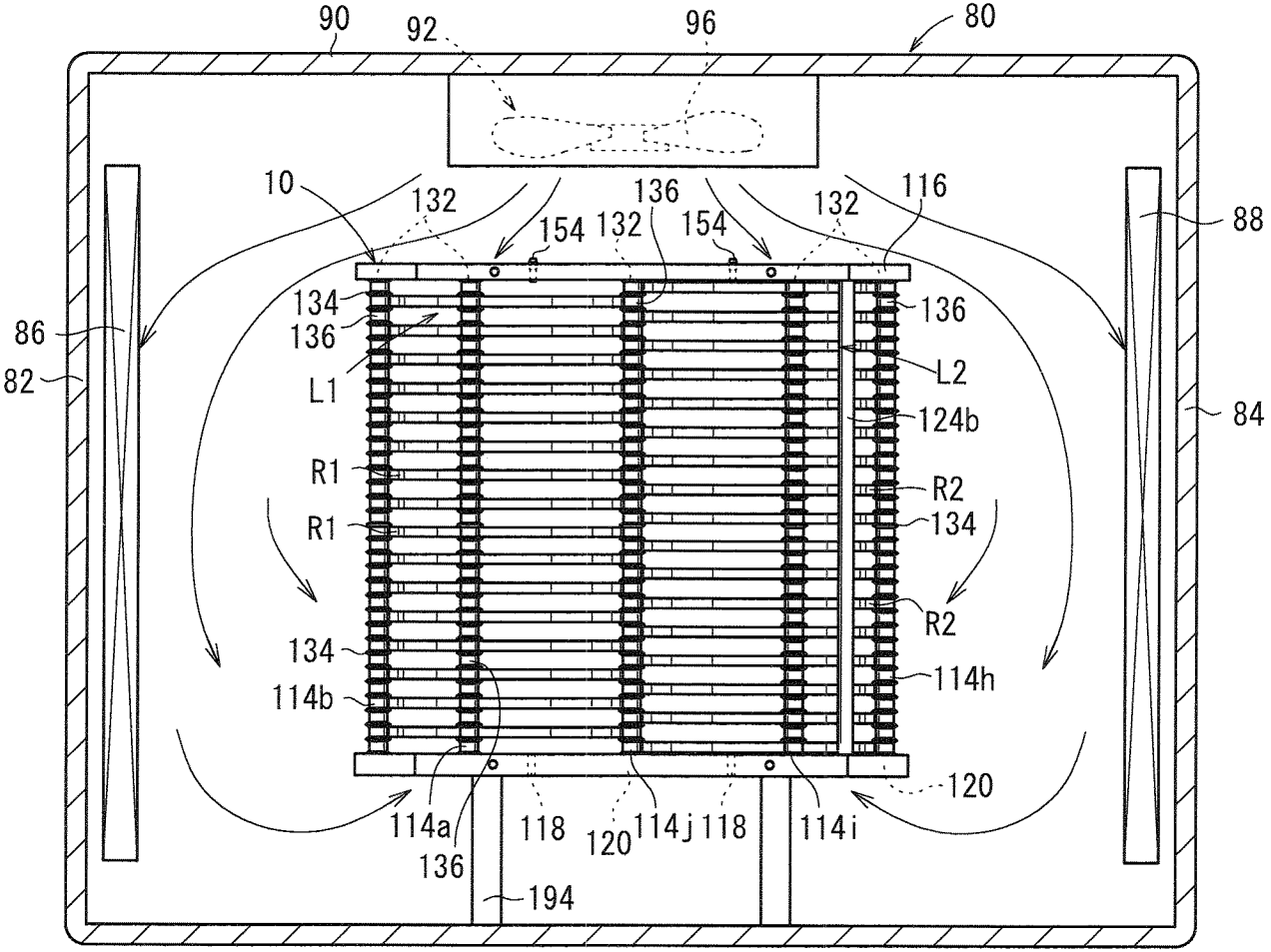
FIG. 16 is a front elevational view, partially in vertical cross section, showing the manner in which the feed rack is introduced into a heat treatment furnace.

Then, the metal rings R1, R2 are fed into a heat treatment furnace 80, as shown in FIG. 16, by a transfer mechanism, not shown. As described above, since the holder shafts 114*a* through 114*j* of the feed jig 110 are hollow, the feed jig 110 is lighter than a feed rack according to the background art, which has solid holder shafts. Furthermore, since the two central holder shafts 114*e*, 114*f* simultaneously hold the first row L1 of metal rings R1 and the second row 12 of metal rings R2, the number of holder shafts used is prevented from increasing. With such an arrangement, the holder shafts 114*a* through 114*j* are made lighter, and hence the feed jig 110 as a whole is made lighter. Therefore, it is easy to convey the feed jig 110, and electric power required to convey the feed jig 110 can be saved.

The holder shafts 114*a* through 114*j* are easily fabricated by cutting a hollow cylindrical tube, as described above. As is well known in the art, hollow cylindrical tubes are quite inexpensive. The cutting process can easily and simply be performed using a known cutting apparatus. Consequently, the cost of raw materials required to fabricate the holder shafts 114*a* through 114*j*, and processing costs for fabricating the holder shafts 114*a* through 114*j* can be lowered.

When the feed jig 110 is placed in the heat treatment furnace 80, the interiors (spaces 132) of the hollow holder shafts 114*a* through 114*j* and the interior of the heat treatment furnace 80 are held in fluid communication with each other through the lower openings of the through holes 120. The heat treatment furnace 80 is elongate along a direction in which the feed jig 110 is fed. The heat treatment furnace 80 includes heaters 86, 88 disposed inwardly of the side walls 82, 84 thereof, and a convection fan 92 mounted on a ceiling wall 90.

The feed jig 110 is supported on the transfer mechanism by a placement jig 94. The feed jig 110 is placed on the placement jig 94 such that the through holes 120 in the base plate 112 are not closed by the placement jig 94.

A nitriding process, which serves as a heat treatment process, will be described below by way of example. The heat treatment furnace 80 shown in FIG. 16 is supplied with a nitriding gas such as ammonia or the like. The nitriding gas is heated by the heaters 86, 88 to a temperature at which the metal rings R1, R2 can be nitrided, e.g., about 500° C.

Nitriding gas, the temperature of which has increased, flows upwardly toward the ceiling wall 90 of the heat treatment furnace 80. According to the second embodiment, the convection fan 92 is actuated in order to rotate agitating vanes 96, for thereby inducing convection in the nitriding gas in the heat treatment furnace 80. Therefore, the nitriding gas descends along the side walls and ascends again near the placement jig 94 and the feed jig 110.

As described above, spaces 132, i.e., the interiors of the holder shafts 114*a* through 114*j*, are held in fluid communication with the interior of the heat treatment furnace 80 through lower and upper openings of the through holes 120. Consequently, as shown in FIGS. 14 and 16, nitriding gas is introduced from the lower openings of the through holes 120. The lower openings of the through holes 120 are oriented upstream with respect to a direction along which the nitriding gas flows, and function as inlet ports for the nitriding gas. The nitriding gas flows through the interiors (spaces 132) of the holder shafts 114*a* through 114*j*, and is discharged from the through holes 138 toward the ceiling wall 90 of the heat treatment furnace 80.

While nitriding gas, the temperature of which has increased, flows through the interiors (spaces 132) of the holder shafts 114*a* through 114*j*, the nitriding gas, the temperature of which is substantially the same as the temperature of the nitriding gas in the holder shafts 114*a* through 114*j*, exists outside of the holder shafts 114*a* through 114*j*. In other words, the nitriding gas exists both within and outside of the holder shafts 114*a* through 114*j* at substantially the same temperature. Therefore, the temperature both within and outside of the holder shafts 114*a* through 114*j* is kept in equilibrium, thus making the temperature of the metal rings R1, R2 substantially uniform throughout. Stated otherwise, the temperature of junctions formed between the holder shafts 114*a* through 114*j* and the metal rings R1, R2 is substantially the same as the temperature of other regions of the metal rings R1, R2.

Inasmuch as the holder shafts 114*a* through 114*j* are hollow, heat transferred from the nitriding gas to the holder shafts 114*a* through 114*j* is efficiently transmitted through the holder shafts 114*a* through 114*j*. Therefore, the temperature of the holder shafts 114*a* through 114*j* themselves, and the temperature of the metal rings R1, R2 held by the holder shafts 114*a* through 114*j*, increases within a short time.

Stated otherwise, the temperature of both the holder shafts 114*a* through 114*j* and the metal rings R1, R2 can be increased using a reduced amount of heat energy. Consequently, electric power needed to perform nitriding on the metal rings R1, R2 can be saved.

The nitriding gas enters into the metal rings R1, R2 from the surfaces thereof, and then is diffused into the metal rings R1, R2, thereby forming nitrided layers on surfaces of the metal rings R1, R2. In other words, nitriding progresses in the metal rings R1, R2. The nitrided layers serve to harden the metal rings R1, R2.

As described above, the temperature of the metal rings R1, R2 is substantially uniform throughout. Therefore, nitriding progresses at substantially the same rate throughout the metal rings R1, R2. The nitriding process is thus prevented from progressing irregularly, and hence the thickness of the nitrided layers and hardening of the metal rings R1, R2 are prevented from becoming irregular.

According to the second embodiment, in which the holder shafts 114*a* through 114*j* are hollow and interiors thereof are held in fluid communication with atmosphere, it is possible for a nitriding gas to flow through the holder shafts 114*a* through 114*j* during nitriding of the metal rings R1, R2. Since the temperature within and outside of the holder shafts 114*a* through 114*j* is kept in equilibrium, the temperature of junctions formed between the metal rings R1, R2 and the holder shafts 114*a* through 114*j* is substantially the same as the temperature of other regions of the metal rings R1, R2. Thus, hardening of the metal rings R1, R2 occurs substantially uniformly throughout.

Inasmuch as the nickel covering layer is formed on surfaces of side walls of the holder shafts 114*a* through 114*j*, constituent elements of the holder shafts 114*a* through 114*j* are prevented from becoming diffused into the metal rings R1, R2 during the nitriding process. In other words, the nickel covering layer functions as a barrier for preventing diffusion of constituent elements of the holder shafts 114*a* through 114*j* into the metal rings R1, R2. The same holds true if the holder shafts 114*a* through 114*j* themselves are made of nickel.

After the metal rings R1, R2 have been nitrided, the feed jig 110 is unloaded from the heat treatment furnace 80. Thereafter, the nuts 148 are loosened, and the joint plate 116 is detached from the holder shafts 114*a* through 114*j* and the column members 124*a*, 124*b*, thereby exposing the metal rings R1, R2.

The exposed metal rings R1, R2 are gripped by the gripping device, detached from the holder shafts 114*a* through 114*j* while deformed in an elliptical shape, and are fed to a given station or storage site. Once released from the gripping device, the metal rings R1, R2 are restored to their original substantially circular shape under elastic recovering forces.

For subsequently holding other new metal rings R1, R2, the feed jig 110, which includes the holder shafts 114*a* through 114*j* fabricated as described above, can be used repeatedly.

Figure 17:
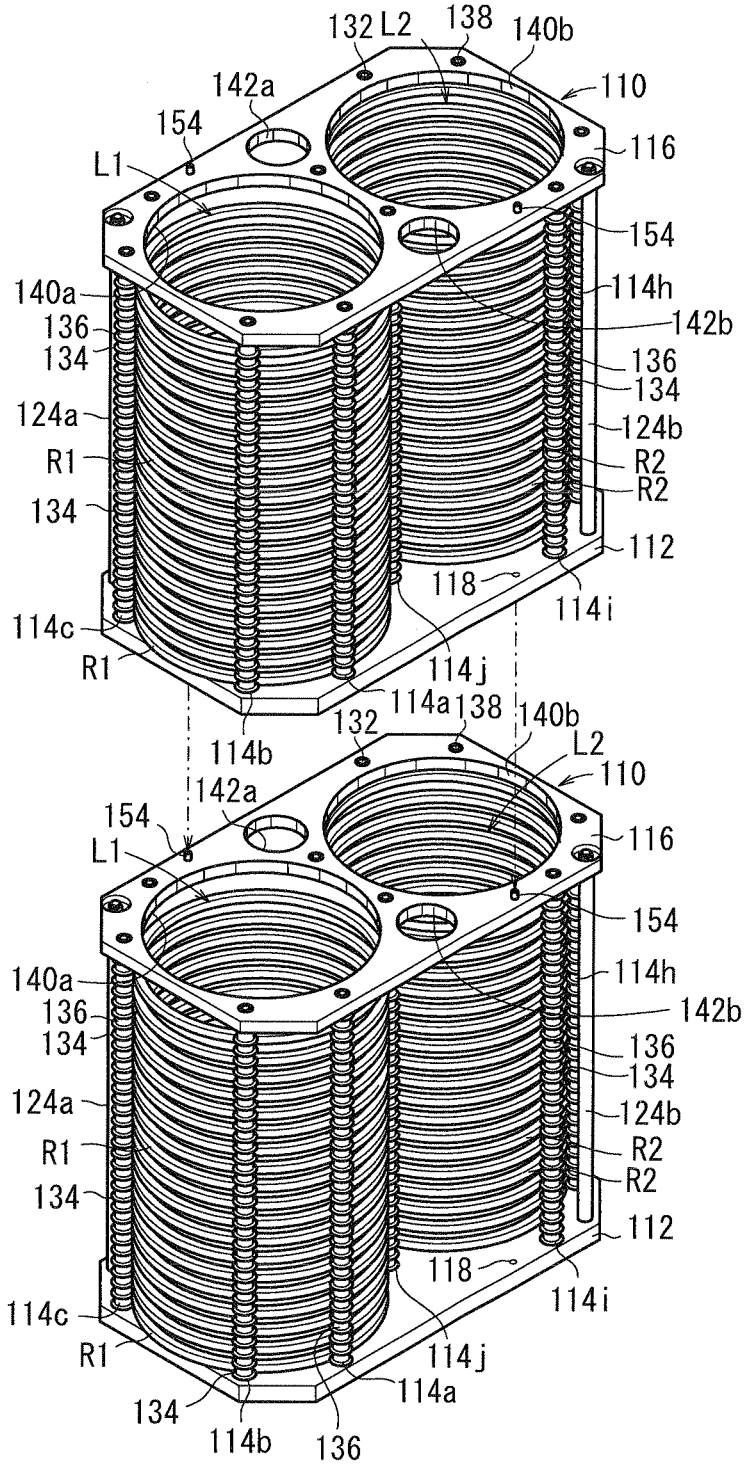
FIG. 17 is an exploded perspective view showing feed racks, which are stacked together.
Figure 18:
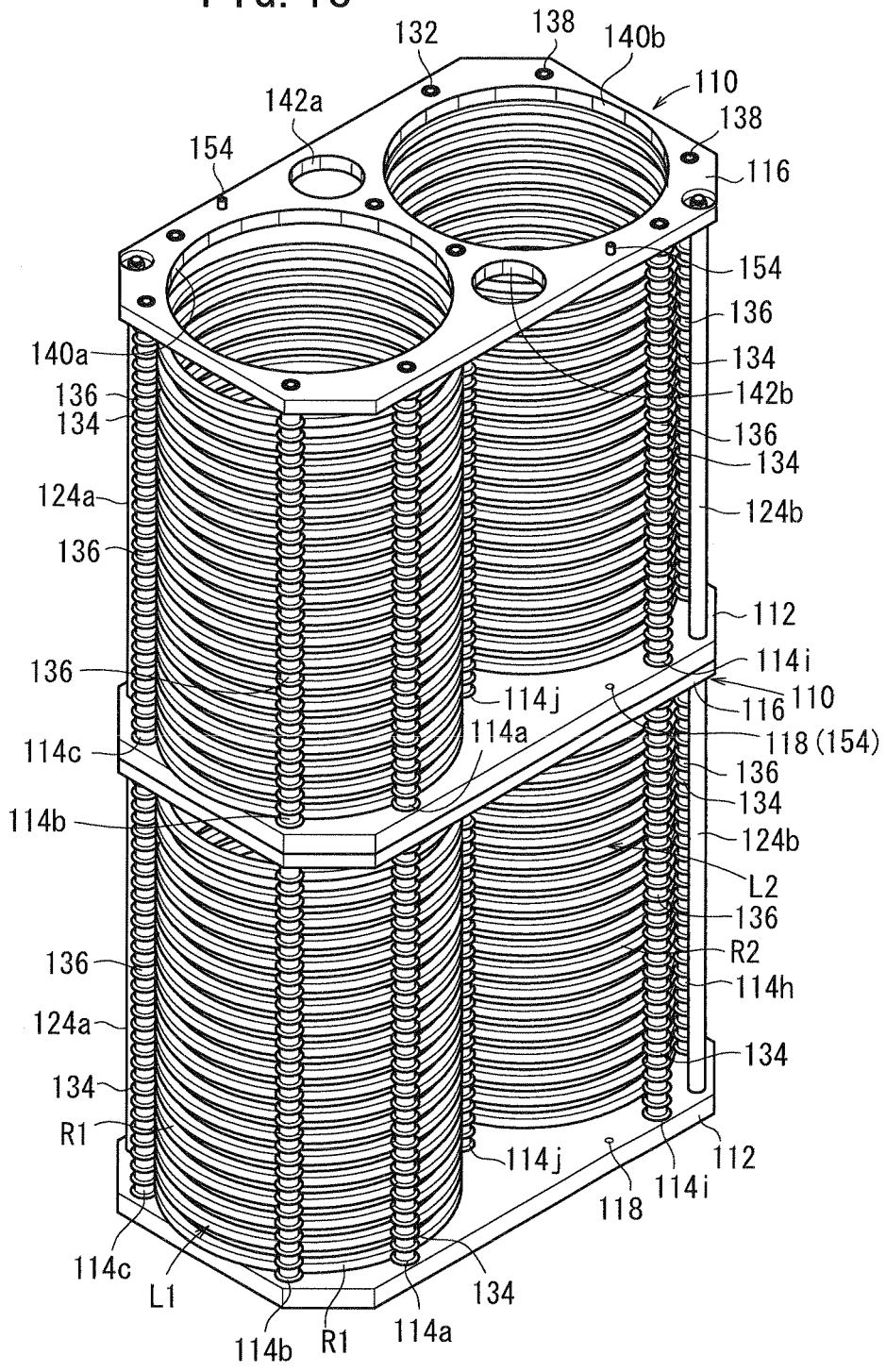
FIG. 18 is an overall schematic perspective view showing the feed racks of FIG. 17, which are stacked together.

As shown in FIG. 16, the feed jig 110 is loaded into the heat treatment furnace 80 without being stacked on other feed jigs. However, if the heat treatment furnace has a large capacity, then, as shown in FIGS. 17 and 18, multiple feed jigs 110, 110 may be stacked one on the other through joint pins 154, and then loaded into the heat treatment furnace. In this case, spaces 132 of the holder shafts 114*a* through 114*f* of the upper feed jig 110 are aligned with spaces 132 of the holder shafts 114*a* through 114*f* of the lower feed jig 110. In other words, the spaces 132, 132 are held in fluid communication with atmosphere, and hence with the interior of the heat treatment furnace.

Similarly, three or more feed jigs 110 may be stacked together.

Figure 19:
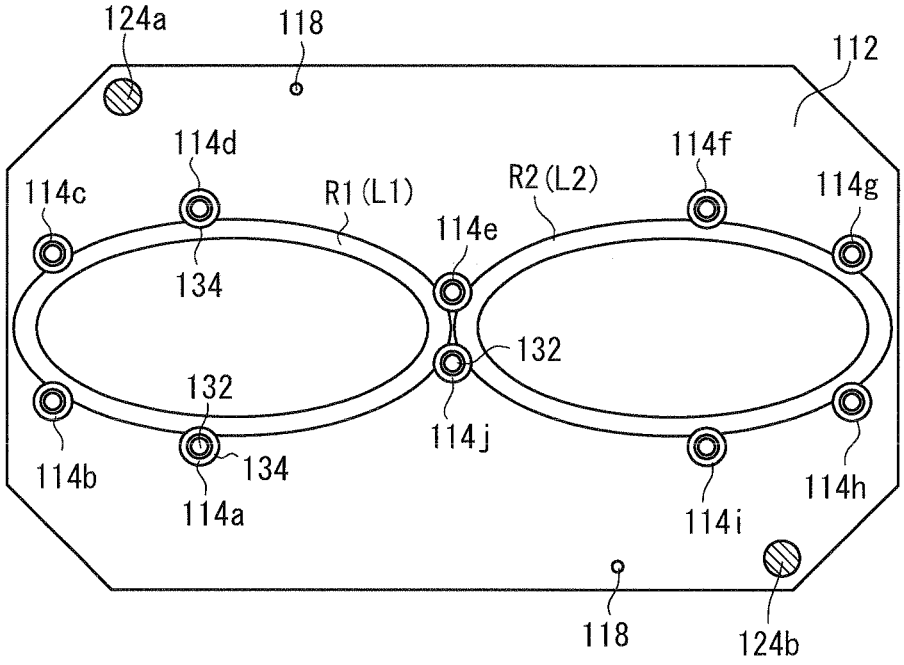
FIG. 19 is a plan view showing the manner in which metal rings are held in an elliptical shape.

As shown in FIG. 19, the holder shafts 114*a* through 114*j* may be set at positions for gripping the metal rings R1, R2 in an elliptical shape. The metal rings R1, R2, which are gripped in this manner, are prevented from becoming elastically deformed in unexpected directions. Accordingly, the metal rings R1, R2, which are restored to their original shape under elasticity, are prevented from being damaged due to contact with other members or mechanisms, and such other members also are prevented from becoming damaged by contact with the metal rings R1, R2.

Inevitably, the metal rings R1, R2 have certain irregularities with respect to the inside diameters, circumferential lengths, widths, etc., thereof. When the metal rings R1, R2 are held in an elliptical shape, however, all of the metal rings R1, R2 are made to have the same minor axis, even though certain irregularities exist with respect to the inside diameters, circumferential lengths, widths, etc. Consequently, all of the metal rings R1, R2 can be held by the holder shafts 114*a* through 114*j*, without experiencing wobbling movements. The metal rings R1, R2 also are prevented from becoming plastically deformed.

This means that the holder shafts 114*a* through 114*j* are capable of holding the metal rings according to other standards (outside diameters), because dimensions of the shorter diameters thereof are brought into agreement with the dimensions of the shorter diameters of the metal rings R1, R2, which are held by the holder shafts 114*a* through 114*j*.

Therefore, holding the metal rings in an elliptical shape is advantageous, in that metal rings according to various standards can be dealt with for better versatility and flexibility.

In the above second embodiment, ten holder shafts 114*a* through 114*j* hold the first row L1 of metal rings R1 and the second row L2 of metal rings R2. However, if the metal rings R1, R2 are held in an annular shape, then at least four holder shafts are sufficient to hold the metal rings R1, R2. Even if the metal rings R1, R2 are held in an elliptical shape, as many holder shafts as required (for example, eight holder shafts) may be used to maintain the elliptical shape.

In the first and second embodiments, interiors of the holder shafts 14*a* through 14*j* and 114*a* through 114*j* are held in fluid communication with atmosphere. However, if the holder shafts 14*a* through 14*j* and 114*a* through 114*j* are hollow, at least one end of the holder shafts may be closed. Such a modification also makes it possible for the feed jig to be made lighter than if solid holder shafts were used.

The heat treatment gas reaches the interiors (spaces 24, spaces 132) of the holder shafts 14*a* through 14*j* and 114*a* through 114*j* by way of diffusion or convection in the heat treatment furnace. Heat from the heat treatment gas, which has reached the interiors, is transferred to the holder shafts 14*a* through 14*j* and 114*a* through 114*j*, and such heat from the heat treatment gas, which surrounds the holder shafts 14*a* through 14*j* and 114*a* through 114*j*, also is transferred to the holder shafts 14*a* through 14*j* and 114*a* through 114*j*. Therefore, the temperature within and outside of the holder shafts 14*a* through 14*j* and 114*a* through 114*j* is kept in equilibrium. Consequently, the temperature of junctions between the metal rings R1, R2 and the holder shafts 14*a* through 14*j* and 114*a* through 114*j* is substantially the same as the temperature of other regions of the metal rings R1, R2.

A feed jig may be constructed, which is made up only of a base plate 12, 112 and the holder shafts 14*a* through 14*j*, without the joint plate 16, 116.

A feed jig according to a third embodiment will be described below.

Figure 20:
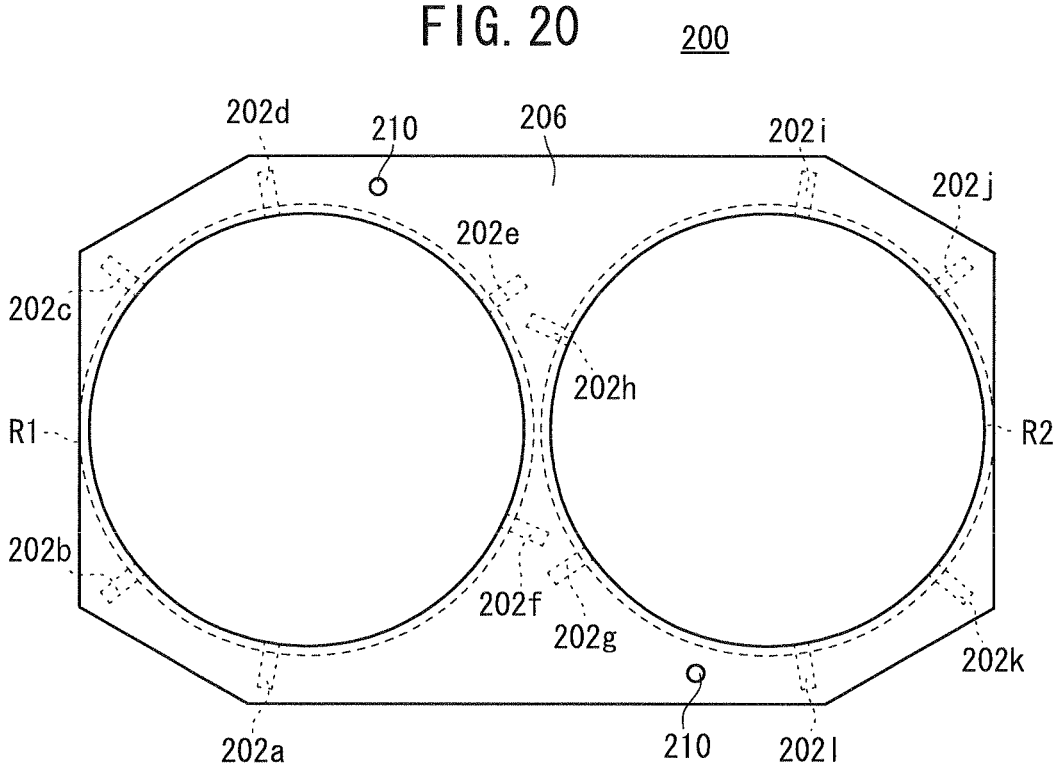
FIG. 20 is a schematic plan view of a feed jig according to a third embodiment of the present invention.
Figure 21:
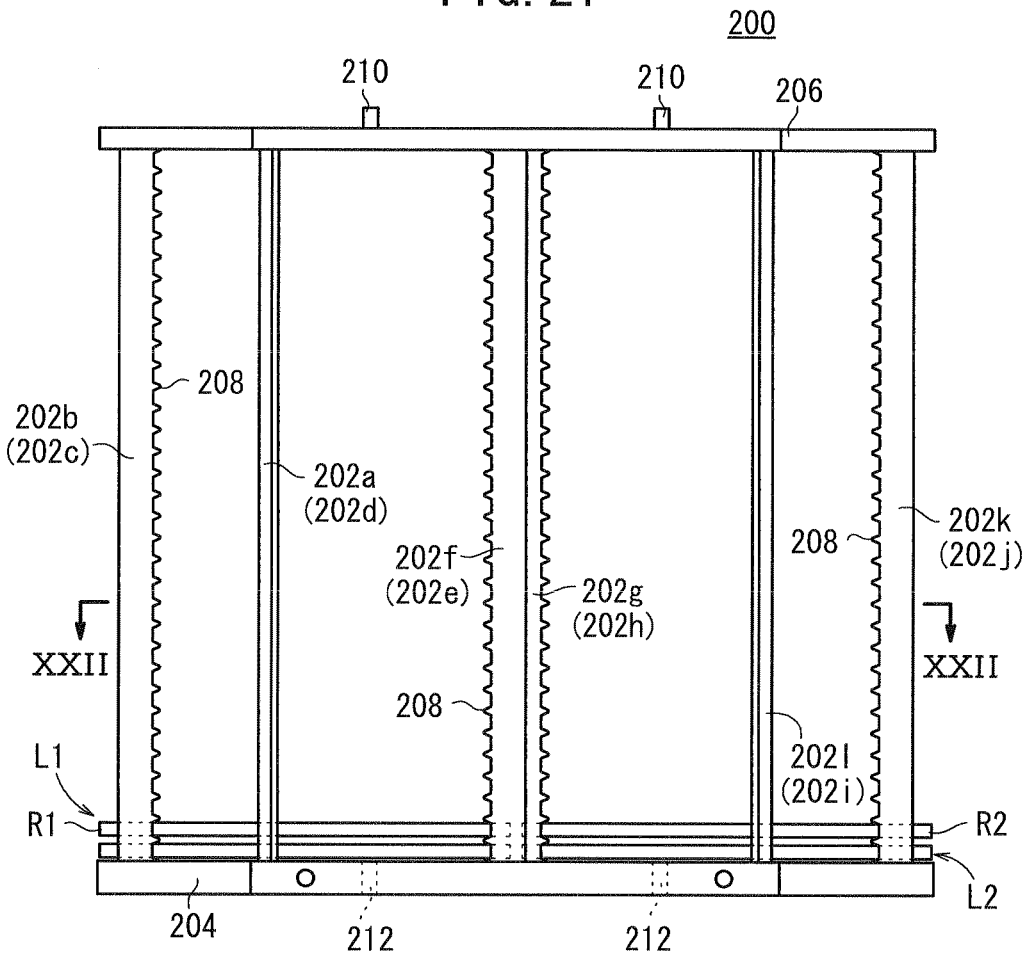
FIG. 21 is an overall schematic front elevational view of the feed jig shown in FIG. 20.
Figure 22:
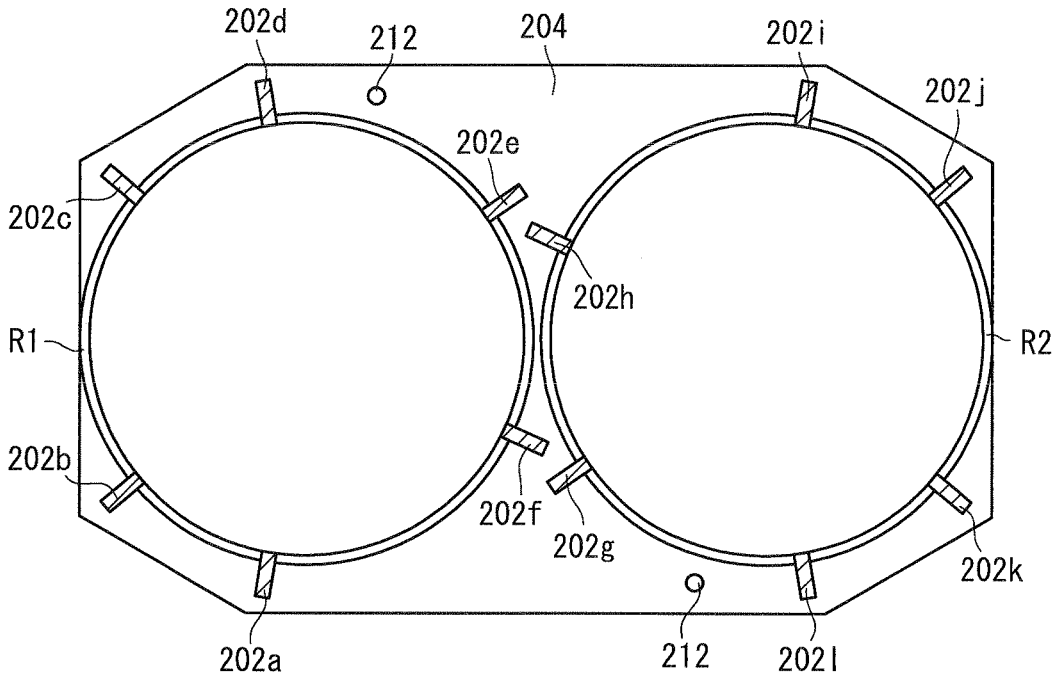
FIG. 22 is a cross-sectional view taken along line XXII-XXII of FIG. 21.

FIG. 20 is a schematic plan view of a feed jig 200 according to a third embodiment of the present invention. FIG. 21 is an overall schematic front elevational view of the feed jig 200. FIG. 22 is a cross-sectional view taken along line XXII-XXII of FIG. 21. As shown in FIGS. 20 through 22, the feed jig 200 includes twelve metal ring holder members 202*a* through 202*l*, which are vertically mounted on a base plate 204 and have distal ends joined to a ceiling plate 206. In other words, the feed jig 200 according to the third embodiment includes three or more metal ring holder members (twelve metal ring holder members 202*a* through 202*l*), which are vertically disposed in abutment against outer circumferential edges of the metal rings R1, R2.

Figure 23:
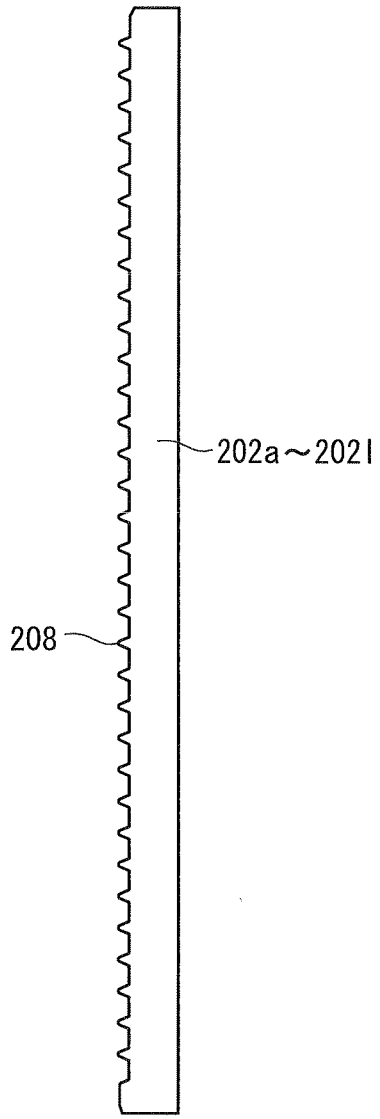
FIG. 23 is a front elevational view of a metal ring holding member of the feed jig shown in FIG. 20.
Figure 24:
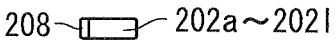
FIG. 24 is a plan view of the metal ring holding member.

FIG. 23 is a front elevational view of each of the metal ring holder members 202 of the feed jig 200, while FIG. 24 is a plan view thereof.

As shown in FIGS. 23 and 24, each of the metal ring holder members 202 has teeth 208 disposed on a surface thereof, which face toward the metal rings R1, R2 and are spaced at constant intervals. The teeth 208 are of a frustoconical shape having tapered slanted surfaces. When each of the metal rings R1, R2 is inserted between two adjacent teeth 208, the outer circumferential edges of the metal ring are held against such slanted surfaces.

The metal ring holder members 202*a* through 202*l* are constructed such that, when the metal ring holder members 202*a* through 202*l* are vertically mounted on the base plate 204, the teeth 208 are positioned at the same height. When the metal rings R1, R2 are inserted between adjacent teeth 208, 208, the metal rings R1, R2 are gripped horizontally.

The metal ring holder members 202*a* through 202*l* should preferably be disposed such that the metal rings R1, R2 held thereby can be of a substantially circular shape. If the metal rings R1, R2 were heat-treated while being held in another shape, then the metal rings R1, R2 tend to be subjected to adverse effects, such as thermal strain or the like, due to the presence of such other shapes. However, the metal rings R1, R2 are free of such adverse effects.

According to the third embodiment, the metal ring holder members 202*a* through 202*l* are each in the form of a plate member having a flat planar shape that extends rearwardly from the surface on which the teeth 208 are disposed. The feed jig 200, with the metal ring holder members 202*a* through 202*l* constructed in the foregoing manner, has a thermal capacity which is much smaller than that of the feed jig disclosed in Japanese Laid-open Patent Publication No. 2007-191788 according to the background art, i.e., a feed jig (see FIG. 4 of Japanese Laid-open Patent Publication No. 2007-191788) having teeth that project concentrically from a metal ring holder member in the form of a cylindrical body, and which are joined to a side wall of the metal ring holder member by tapered slanted surfaces.

Therefore, the metal ring holder members 202*a* through 202*l* exhibit good thermal followability during the heat treatment process, resulting in a reduction in the rate at which the diameters of the metal rings R1, R2 are changed during the heat treatment process.

In addition, since the metal ring holder members 202*a* through 202*l* have a flat planar shape, it is possible to make the metal ring holder members 202*a* through 202*l* lighter in weight, and hence to make the feed jig 200 lighter as a whole. An experimental example, which was conducted for making the metal ring holder members lighter in weight, achieved a reduction in weight by about 20%.

Furthermore, the metal ring holder members 202*a* through 202*l* should preferably be hollow members. Hollow metal ring holder members 202*a* through 202*l* are much lighter, and provide better thermal followability during the heat treatment process, as a result of introducing a heated atmosphere into spaces in the metal ring holder members 202*a* through 202*l* when the metal ring holder members 202*a* through 202*l* are heated during the heat treatment process. An experimental example, which was conducted for making the metal ring holder members lighter in weight, achieved a reduction in weight by about 40%, and a reduction in weight by about 14% per jig.

Moreover, the metal ring holder members 202*a* through 202*l* should preferably be plated with nickel. If the metal ring holder members 202*a* through 202*l* are made of a material containing Cu, Cr, or the like, then such metal ring holder members 202*a* through 202*l* are likely to interfere with a uniform nitriding reaction, in regions where the metal ring holder members 202*a* through 202*l* contact the teeth 208 of the metal rings R1, R2. The metal ring holder members 202*a* through 202*l* may also be made of pure nickel.

The feed jig 200 having the above structure holds the metal rings R1, R2 in the following manner. A gripping means simultaneously grips a plurality of metal rings R1, which are substantially circular in shape, and thereafter diametrically presses the metal rings R1 into a substantially elliptical shape. Then, the gripping means inserts the metal rings R1 into the metal ring holder members 202*a* through 202*la* through 202*f*, while keeping the metal rings R1 deformed with diameters thereof oriented horizontally.

Thereafter, the gripping means releases the metal rings R1 from the pressing forces, whereupon the metal rings R1 are restored from an elliptical shape to a substantially circular shape, under elastic forces thereof. Outer circumferential surfaces of the metal rings R1, R2 are moved closer toward the faces of the metal ring holder members 202*a* through 202*la* through 202*f*, which are formed with teeth 208 thereon.

The gripping means continues to release the metal rings R1 from the pressing forces, while controlling the horizontal orientation of the metal rings R1, such that outer circumferential surfaces thereof are inserted between adjacent ones of the teeth 208, 208 of the metal ring holder members 202*a* through 202*la* through 202*f*, which are positioned at the same height as the metal rings R1. Outer circumferential edges of the metal rings R1 are gripped between adjacent teeth 208, 208 of the metal ring holder members 202*a* through 202*l*, and are held horizontally.

The metal rings R2 are similarly processed until the metal rings R2 are held between the teeth 208, 208 of the metal ring holder members 202*a* through 202*lg* through 202*f*. The metal rings R1, R2 thus are held in two vertical rows, which are juxtaposed horizontally.

The feed jig 200, which holds several metal rings R1, R2 as described above, is introduced alone, or alternatively, stacked feed jigs (see FIGS. 17 and 18) with positioning pins 210 fitted in positioning holes 212 thereof are introduced into an aging and nitriding furnace. Them, the metal rings R1, R2 are heat-treated in the aging and nitriding furnace.

If an aging process and a nitriding process are carried out in successive furnaces, then the metal rings R1, R2 can be delivered between the furnaces by the feed jig 200. If the nitriding process is carried out as a gas nitriding process, then since the furnace used to carry out the nitriding process is a batch-type furnace, the loading ratio of metal rings R1, R2 on the feed jig 200 greatly affects the heat treatment efficiency.

In this respect, according to the third embodiment, the twelve metal ring holder members 202*a* through 202*l* are used to hold the metal rings R1, R2 in two vertical rows, which are juxtaposed horizontally. With this arrangement, assuming that the numbers of metal rings R1, R2 are identical, then the number of jigs required to hold the metal rings R1, R2 is reduced. Consequently, the weight and volume of the jig can be reduced.

For example, the weight and volume of the feed jig 200 are made smaller by about 9% and about 10%, respectively, than two feed jigs each having six metal ring holder members 202*a* through 2021*a* through 202*f*, which are capable of holding only the metal rings R1.

As with the first and second embodiments, the metal rings R1, R2 may simultaneously be held by metal ring holder members, where the metal rings R1, R2 are installed in regions that are closest to each other. Such a modified arrangement is effective at further reducing the number of metal ring holder members, and as a result, further serves to reduce the weight and volume of the jig.

With the above modified arrangement, end faces of the metal ring holder members that face toward the metal rings R1, and end faces thereof that face toward the metal rings R2 may have teeth 208.

Figure 25:
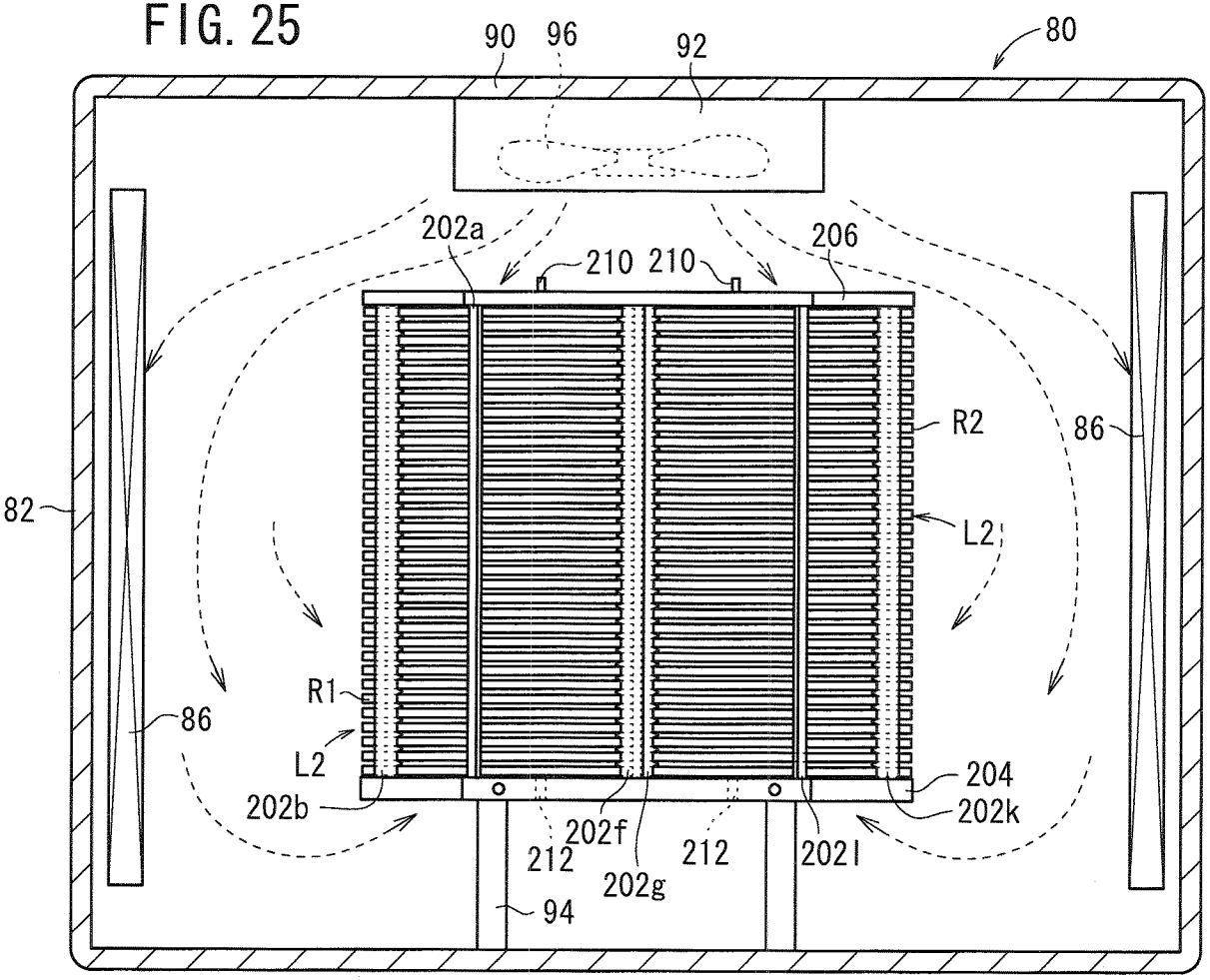
FIG. 25 is an overall schematic vertical cross-sectional view showing the manner in which metal rings, which are held by the feed jig, are heat-treated in a furnace.

The feed jig 200, which holds the several metal rings R1, R2, is fed into a heat treatment furnace 80 shown in FIG. 25 by a feed means, not shown. Similar to the above heat treatment furnaces, the heat treatment furnace 80 is elongate along a direction in which the feed jig 200 is fed, and further includes heaters 86, 88 disposed inwardly of side walls 82, 84, and a convection fan 92 mounted on a ceiling wall 90.

Subsequently, a heat treatment process is carried out in the same manner as with the first embodiment.

More specifically, using the feed jig 200 in the heat treatment furnace 80, the interiors of the hollow metal ring holder members 202*a* through 202*l* and the interior of the heat treatment furnace 80 are held in fluid communication with each other through openings of the hollow metal ring holder members 202*a* through 202*l*. A nitriding process, which serves as the heat treatment process, will be described below by way of example. The heat treatment furnace 80 is supplied with a nitriding gas such as ammonia or the like. The nitriding gas is heated by the heaters 86, 88 to a temperature at which the metal rings R1, R2 are capable of being nitrided, e.g., about 500° C. The heated nitriding gas flows upwardly toward the ceiling wall 90 of the heat treatment furnace 80. When the convection fan 92 is actuated in order to rotate agitating vanes 96, the nitriding gas, which has ascended, is subjected to convection within the heat treatment furnace 80.

The nitriding gas flows downwardly along the side walls 82, 84, and then ascends again near the floor of the heat treatment furnace 80 and the feed jig 200. As described above, the interiors of the metal ring holder members 202*a* through 202*l* are held in fluid communication with the interior of the heat treatment furnace 80 at both ends thereof. Consequently, as shown in FIG. 25, nitriding gas is introduced from the lower openings of the metal ring holder members 202*a* through 202*l*. The lower openings of the metal ring holder members 202*a* through 202*l* are oriented upstream with respect to a direction along which the nitriding gas flows, and function as inlet ports for the nitriding gas. Nitriding gas flows through the interiors of the metal ring holder members 202*a* through 202*l*, and is discharged from the upper openings toward the ceiling wall 90 of the heat treatment furnace 80.

In the foregoing manner, in which the metal ring holder members 202*a* through 202*l* are plate members interiors of which are held in fluid communication with atmosphere, a heated nitriding gas flows through the metal ring holder members 202*a* through 202*l*. The nitriding gas, which is heated to substantially the same point as in the metal ring holder members 202*a* through 202*l*, also exists outside of the metal ring holder members 202*a* through 202*l*. In other words, the nitriding gas, which is heated to the same point, is present both within and outside of the metal ring holder members 202*a* through 202*l*. Therefore, the temperature both within and outside of the metal ring holder members 202*a* through 202*l* is kept in equilibrium, thereby making the temperature of the metal rings R1, R2 substantially uniform in its entirety. Stated otherwise, the temperature of junctions between the metal ring holder members 202*a* through 202*l* and the metal rings R1, R2 is substantially the same as the temperature of the other regions of the metal rings R1, R2. The nitriding gas enters into the metal rings R1, R2 from surfaces thereof, and then is diffused into the metal rings R1, R2 in order to form nitrided layers on the surfaces of the metal rings R1, R2. In other words, nitriding progresses in the metal rings R1, R2. The nitrided layers serve to harden the metal rings R1, R2.

As described above, the temperature of the metal rings R1, R2 is substantially uniform in its entirety. Therefore, nitriding progresses at a substantially constant rate throughout the entirety of the metal rings R1, R2. The feed jig 200, which is used in this manner, exhibits good thermal followability during the heat treatment process, and nitriding is prevented from progressing irregularly. The thickness of the nitrided layers, and hence hardening of the metal rings R1, R2, is prevented from becoming irregular, thereby resulting in a reduction in the rate at which the diameter of the metal rings R1, R2 changes during the heat treatment process.

In the third embodiment, as with the joint plate 116 shown in FIG. 11, it is possible to make the base plate 204 and the ceiling plate 206 lighter as a result of the through holes defined therein. Therefore, the feed jig 200 has increased thermal efficiency and is further reduced in weight.

In the third embodiment, the base plate 204 and the ceiling plate 206 may be dispensed with, and a frame configuration may be employed, in which the metal ring holder members 202*a* through 202*l* extend parallel to each other. In this case, it is possible to hold the metal rings R1, R2 through openings, which are defined by the metal ring holder members 202*a* through 202*l*.

In the first through third embodiments above, metal rings R1, R2 for use in a CVT belt have been illustrated as a workpiece, and a nitriding process has been described as a heat treatment process. However, the present invention is not limited to such a workpiece and such a heat treatment process. For example, if a workpiece is a ring member that needs to be carburized, then a carburizing gas may be supplied instead of the aforementioned nitriding gas.

The invention claimed is:

1. A feed jig for feeding a metal ring having an elastic recovering capability, comprising:

a base plate; and at least three holder shafts vertically mounted on the base plate and extending parallel to each other, wherein each of the holder shafts comprises a hollow body having a plurality of recesses defined in a side wall thereof by performing a hydroforming process, for holding the metal ring.

2. The feed jig according to claim 1, wherein the holder shafts have respective interiors held in fluid communication with atmosphere.

3. The feed jig according to claim 2, further comprising:

a joint plate spaced from the base plate and joined to respective ends of all of the holder shafts.

4. The feed jig according to claim 1, wherein the feed jig comprises at least four holder shafts for feeding said metal rings, which are arranged in two vertical rows including a first row and a second row, and wherein two of the four holder shafts hold both of the metal rings in the first row and the metal rings in the second row, and the remaining two of the four holder shafts hold either one of the metal rings in the first row or the metal rings in the second row.

5. The feed jig according to claim 4, wherein the holder shafts have respective surfaces with nickel layers formed thereon.

6. The feed jig according to claim 4, wherein the holder shafts are made of nickel or a nickel-based alloy.

7. The feed jig according to claim 4, wherein the feed jig holds the metal rings in an elliptical shape.

8. A feed jig for feeding a metal ring having an elastic recovering capability, comprising:

a base plate; and at least three holder shafts vertically mounted on the base plate and extending parallel to each other, wherein each of the holder shafts comprises a hollow body pressed by a die from an inner wall thereof to have a plurality of ridges on a side wall thereof and a plurality of recesses between the ridges, for holding the metal ring.

9. The feed jig according to claim 8, wherein the holder shafts have respective interiors held in fluid communication with atmosphere.

10. The feed jig according to claim 9, further comprising:

a joint plate spaced from the base plate and joined to respective ends of all the holder shafts.

11. The feed jig according to claim 8, wherein the feed jig comprises at least four holder shafts for feeding said metal rings, which are arranged in two vertical rows including a first row and a second row, and wherein two of the four holder shafts hold both of the metal rings in the first row and the metal rings in the second row, and the remaining two of the four holder shafts hold either one of the metal rings in the first row or the metal rings in the second row.

12. The feed jig according to claim 11, wherein the holder shafts have respective surfaces with nickel layers formed thereon.

13. The feed jig according to claim 11, wherein the holder shafts are made of nickel or a nickel-based alloy.

14. The feed jig according to claim 11, wherein the feed jig holds the metal rings in an elliptical shape.

15. A method of manufacturing a feed jig for holding and feeding a metal ring having an elastic recovering capability, with recesses defined in side walls of at least three holder shafts, comprising the steps of:

performing a hydroforming process on hollow bodies in order to form recesses in side walls thereof, thereby producing hollow holder shafts; and mounting the holder shafts vertically on a base plate.

16. The method according to claim 15, further comprising:

joining respective ends of all of the holder shafts to a joint plate.

17. A method of manufacturing a feed jig for holding and feeding a metal ring having an elastic recovering capability, with recesses defined in side walls of at least three holder shafts, comprising the steps of:

pressing a die against inner walls of hollow bodies in order to raise a plurality of ridges on the side walls and form a plurality of recesses in the side walls between the ridges, thereby producing hollow holder shafts; and mounting the holder shafts vertically on a base plate.

18. The method according to claim 17, further comprising:

joining respective ends of all of the holder shafts to a joint plate.

19. A method of heat-treating a metal ring having an elastic recovering capability, comprising the steps of:

holding the metal ring with recesses defined in side walls of at least three holder shafts of a feed jig, the holder shafts comprising hollow bodies, respectively;

introducing the feed jig, which holds the metal ring, into a heat treatment furnace; and heat-treating the metal ring in the heat treatment furnace while an atmospheric gas flows through the holder shafts, wherein the metal rings are heat-treated, while the holder shafts have respective interiors held in fluid communication with the heat treatment furnace, and wherein inlets for introducing the atmospheric gas into the holder shafts are oriented upstream with respect to a direction along which the atmospheric gas flows.

20. The method of heat-treating according to claim 19, wherein the feed jig including at least four holder shafts is used for holding the metal rings, which are arranged in two vertical rows including a first row and a second row, the method further comprises the step of holding both of the metal rings in the first row and the metal rings in the second row on two of the four holder shafts, and holding either one of the metal rings in the first row or the metal rings in the second row on a remaining two of the four holder shafts.

21. The method according to claim 20, wherein the metal rings are held in an elliptical shape.

22. A feed jig for holding a plurality of metal rings having an elastic recovering capability in a row within three or more metal ring holder members that extend parallel to each other, wherein:

each of the metal ring holder members comprises a columnar member having a polygonal cross-sectional shape as viewed in a longitudinal direction, and a side surface facing the metal rings;

each of the metal ring holder members has teeth for holding the metal rings, the teeth being disposed only on an end face thereof that faces toward the metal rings; and the metal rings have outer circumferential edges gripped between adjacent ones of the teeth.

23. The feed jig according to claim 22, wherein the metal ring holder members comprise hollow members.

24. The feed jig according to claim 22, which includes as many metal ring holder members as required to hold the metal rings in a plurality of rows.

* * * * *